US007740339B2

(12) United States Patent
Yano

(10) Patent No.: US 7,740,339 B2
(45) Date of Patent: Jun. 22, 2010

(54) PROTECTION DEVICE FOR AN INK CARTRIDGE STORAGE UNIT

(75) Inventor: Hiroyasu Yano, Nagoya (JP)

(73) Assignee: Brother Kogyo Kabushiki Kaisha, Nogoya-shi, Aichi-ken (JP)

( * ) Notice: Subject to any disclaimer, the term of this patent is extended or adjusted under 35 U.S.C. 154(b) by 567 days.

(21) Appl. No.: 11/693,560

(22) Filed: Mar. 29, 2007

(65) Prior Publication Data

US 2007/0229625 A1 Oct. 4, 2007

(30) Foreign Application Priority Data

Mar. 31, 2006 (JP) ..... 2006-100499

(51) Int. Cl.
*B41J 2/14* (2006.01)

(52) U.S. Cl. ..... 347/49

(58) Field of Classification Search ..... 347/49, 347/50, 84, 85, 86, 87
See application file for complete search history.

(56) References Cited

U.S. PATENT DOCUMENTS 5,119,115 A * 6/1992 Buat et al. ..... 347/86
5,250,957 A * 10/1993 Onozato ..... 347/7
5,604,523 A * 2/1997 Tsukuda et al. ..... 347/86
5,821,967 A * 10/1998 Solero ..... 347/87
6,039,443 A 3/2000 Dunphy et al.
6,132,036 A 10/2000 Abe et al.
6,382,783 B1 * 5/2002 Hayashi et al. ..... 347/85
6,736,486 B2 * 5/2004 Nakamura et al. ..... 347/49
6,827,417 B2 12/2004 Seino
7,452,066 B2 * 11/2008 Tsuji ..... 347/108
2007/0229582 A1 10/2007 Yano

FOREIGN PATENT DOCUMENTS

EP 1602487 A1 12/2005
JP H09-076525 A 3/1997
JP H11-157094 A 6/1999
JP 2002-079690 A 3/2002
JP 2003-054000 A 2/2003
JP 2003-312005 A 11/2003
JP 2004-017446 A 1/2004
JP 2004-230857 A 8/2004
JP 2005-238857 A 9/2005

* cited by examiner

*Primary Examiner*—Anh T. N. Vo
(74) *Attorney, Agent, or Firm*—Baker Botts L.L.P.

(57) ABSTRACT

A protection device for an ink cartridge storage unit having an ink inducing member and a cover member is provided with a main body having an front face and a rear face, a sealing member connected to the front face, and a guiding protrusion arranged at the rear face. The cover member includes a pair of projections arranged at a location that corresponds to the guiding protrusion of the protection device. The width of the guiding protrusion is equal to or smaller than the width between the pair of projections, and the guiding protrusion is guided in between the pair of projections in the course of rotating the cover member to its closed state.

9 Claims, 13 Drawing Sheets

PROTECTION DEVICE FOR AN INK CARTRIDGE STORAGE UNIT

CROSS-REFERENCE TO RELATED APPLICATION

This application claims priority to Japanese Patent Application No. 2006-100499, filed on Mar. 31, 2006, the contents of which are hereby incorporated by reference into the present application.

BACKGROUND OF THE INVENTION

1. Field of the Invention

The present invention relates to a protection device for a storage unit (a refill unit) of ink cartridges utilized in an ink jet printer.

2. Description of the Related Art

An ink jet printer known in general has a housing in which a print head, one or more ink tanks (ink cartridges), and a carriage is installed. The print head includes a nozzle for discharging ink, and is arranged on the carriage. The carriage is able to move in the perpendicular direction with respect to a printing medium (a sheet of printing paper, for example); that is, the carriage is able to move in the main scanning direction. The print head is connected to the ink tank, and discharges the ink provided therefrom via the nozzle. The printing medium is conveyed through the housing of the ink jet printer, and the ink discharged from the nozzle is printed thereon.

The ink jet printers can be roughly categorized into two types: an on-carriage type, and an off-carriage type. Such categorization can be made based on the arrangement of the ink cartridge. The on-carriage type and the off-carriage type both include a storage unit, or a storage case for detachably storing the ink cartridge. The on-carriage type has the storage unit arranged on the movable carriage. With this type of carriage, the ink is provided directly from the storage unit to the print head. On the other hand, the off-carriage type has the storage unit arranged inside the housing, but not on the movable carriage. The ink cartridge stored in the storage unit is connected to the print head by a relaying member; for example, an ink tube. The ink is provided from the remote storage unit to the print head that is supported on the carriage via the ink tube.

With either of the types of ink jet printers as described above, the ink cartridge must be replaced with a new one, or be refilled, when the volume of remaining ink becomes insufficient.

With the typical types of ink jet printers as described above, the storage unit has an ink inducing member that provides ink to the print head. Correspondingly, the ink cartridge has a connecting portion, such as an ink providing valve. To provide the ink to the print head from the ink cartridge, the ink inducing member of the storage unit is connected to the connecting portion of the ink cartridge. In a case where the ink inducing member is in the shape of a narrow needle or tube, the ink inducing member is easily bent or broken in the course of installing and removing the ink cartridge to and from the storage unit. Thus, a guiding portion, for example, a plurality of guiding ribs or a guiding tube section are formed on the periphery of the ink inducing member, while an insert tube corresponding to the aforementioned guiding ribs or the guiding tube section is formed on the connecting portion of the ink cartridge, to insert therein.

Ink jet printers of both the on-carriage type and the off-carriage type undergo a print test before shipment. The print test is performed to confirm that the printing mechanism is functioning. In such a test, one or more ink cartridge is installed in the storage unit, and after the print test, the ink cartridge is removed from the storage unit before shipment. The ink inside the print head can be left or removed prior to shipment. In the case where the ink is removed from the print head, the print head is refilled with a preservative liquid which has the same characteristic as the ink without pigments or dyestuffs. Then, a protection device, such as a protection cap or a dummy cartridge (that is, a cartridge with no ink inside), is installed in the case to cover the ink inducing member. The protection device prevents the leakage of the ink or the preservative liquid (the term "liquid" will be used as the general term for both the ink and the preservative liquid in the description below). The surface of the print head on which the nozzle is arranged is also covered with a nozzle cap to prevent the leakage of the liquid, and for the protection of the nozzle. Such a technique is taught in the Japanese Patent Application Publications No. 2002-79690, No. 2004-230857, No. 2005-238857, No. 2003-54000, and No. 11-157094.

In the aforementioned techniques, a rubber cork or a rubber cap is arranged on the protection device. The ink inducing member and the rubber cork (see FIG. 3 of the Japanese Patent Application Publication No. 2002-79690) or a cap (see Japanese Patent Application Publication No. 2005-238857 and No. 2003-54000) of the protection device are connected and sealed so as to prevent the leakage therefrom.

Furthermore, in the aforementioned techniques, fastening members such as levers, hooks, or the like are utilized to fasten the installed protection device inside the storage unit. For example, in the technique taught in Japanese Patent Application Publication No. 2003-54000, a weight lever (that is, the fastening member) arranged on the storage unit fastens and holds the protection member pressed against the ink inducing member. Such configuration improves the sealing of the ink inducing member, and as the result, the leakage therefrom is prevented.

In the technique taught in Japanese Patent Application Publication No. 11-157094, the fastening member includes a handle rotatably connected to the storage unit in the vicinity of the opening of the storage unit by a shaft, a link plate whose end is connected to the handle and arranged along the bottom surface inside the storage unit, and a link lever connected to the opposite end of the link plate. In the teaching of the above-mentioned technique, the handle has two side plates and an attaching surface formed therebetween. In the course of inserting the protection device, it can be set on the link plate. By rotating the handle towards the protection device, the attaching surface makes contact with the rear side surface of the protection device, enabling it to push the protection device into the storage unit.

However, according to the above-mentioned teaching, a large number of components are required for constructing such configuration. Furthermore, with such configuration, when the ink cartridge is installed inside the storage unit, the fastening member is arranged below the bottom surface of the storage case. Hence, such space for the fastening member must be reserved, which causes the storage unit to occupy much more space.

Furthermore, in the teachings of the aforementioned techniques, the protection device is not guided in the course of inserting it into the storage unit. Though the position in a horizontal direction (the direction of insertion) to the ink inducing member can be maintained by the fastening members of the aforementioned techniques, the position of the protection member in the direction orthogonal to the direction of insertion (for example, the left and right direction, or the up and down direction with respect to the direction of the insertion) must be determined manually.

Hence, if the protection device is inserted into the storage unit in an inappropriate position or angle, the sealing of the ink inducing member becomes insufficient. As a result, liquid leakage and/or damages on the ink inducing member due to such inappropriate position may occur. For example, following impact from vibrations due to transportation, the seal between the protection device and ink inducing member may be loosened, resulting in ink leakage. Moreover, in such condition, the inappropriate position of the protection device may cause the ink inducing member to be bent or broken. A measure to prevent such undesirable conditions has been sought for.

BRIEF SUMMARY OF THE INVENTION

The objective of the present invention is to provide a protection device for an ink cartridge storage unit, maintaining the essential function of preventing the leakage and the dehydration of liquid as well as the function of preventing the bending and breaking of the ink inducing member, while also ensuring that the protection device can be installed and removed easily in an appropriate position or angle. To achieve such an objective, the following technique taught in the present specification was developed.

The protection device disclosed in the present specification is utilized for an ink cartridge storage unit having a storage main body with one side having an opening, an ink inducing member arranged on a surface of the main body facing the side having the opening, and a cover member for covering the opening. The cover member is connected to the storage main body and rotates between an opened state and a closed state. It also includes a pair of projections arranged on an interior surface of the cover member that faces the ink inducing member in the closed state In order to adopt to such configuration of the ink cartridge storage unit, the protection device includes a main body, a sealing member, and a guiding protrusion.

The main body has an front face and a rear face. The front face horizontally faces the rear face, and the sealing member is connected to and protruding from the front face. When the protection device is inserted into the storage main body and the cover member is rotated to its closed state, the sealing member is to engage and seal the ink inducing member arranged thereof.

The guiding protrusion is arranged at and protruding from the rear face. The guiding protrusion is located at a position corresponding to the location of which the pair of projections is arranged on the cover member. Furthermore, the width of the guiding protrusion is equal to or smaller than the width between the pair of projections. That is, the guiding protrusion fits in between the pair of projections in the course of closing the cover member, and thus is guided therein. Even in a case where the guiding protrusion is slightly located inappropriately in the left and right direction (that is, in the case of having a poor alignment of the protection device and the ink inducing member, or an improper insertion of the protection device), the guiding protrusion is guided by the pair of projections, and thus the position of the protection device in the left and right direction with respect to the direction of insertion is modified. With the configuration as described above, the alignment of the protection device does not need to be determined manually, thus the insertion process can be simplified. Further, liquid leakage and/or damages on the ink inducing member due to the inappropriate position in the above mentioned direction is prevented.

The pair of projections arranged on the cover member does not need to be a component exclusively formed for the above mentioned guiding function. For example, the guiding protrusion and the pair of projections can be configured to determine the position in other directions besides the direction as mentioned above. Furthermore, the pair of projections may be utilized both as a guiding means for the protection device as well as the ink cartridge, and as a means to pull the protection device and ink cartridge out of the storage main body in the course of opening the cover member. Also, the pair of projections can be formed as one component, or can be separately arranged on the cover member to function cooperatively.

With the configuration as described above, when the protection device is installed inside the storage main body, the sealing member engages with the ink inducing member and seals it, while the rear face of the protection device is pressed with the cover member towards the ink inducing member. Such sealing and posture is maintained during shipping or transportation of the ink jet printer, hence the ink inducing member and the sealing of it is appropriately protected.

DETAILED DESCRIPTION OF THE INVENTION

The preferred embodiment of the present invention will be described in detail below with reference to the figures.

Figure 1:
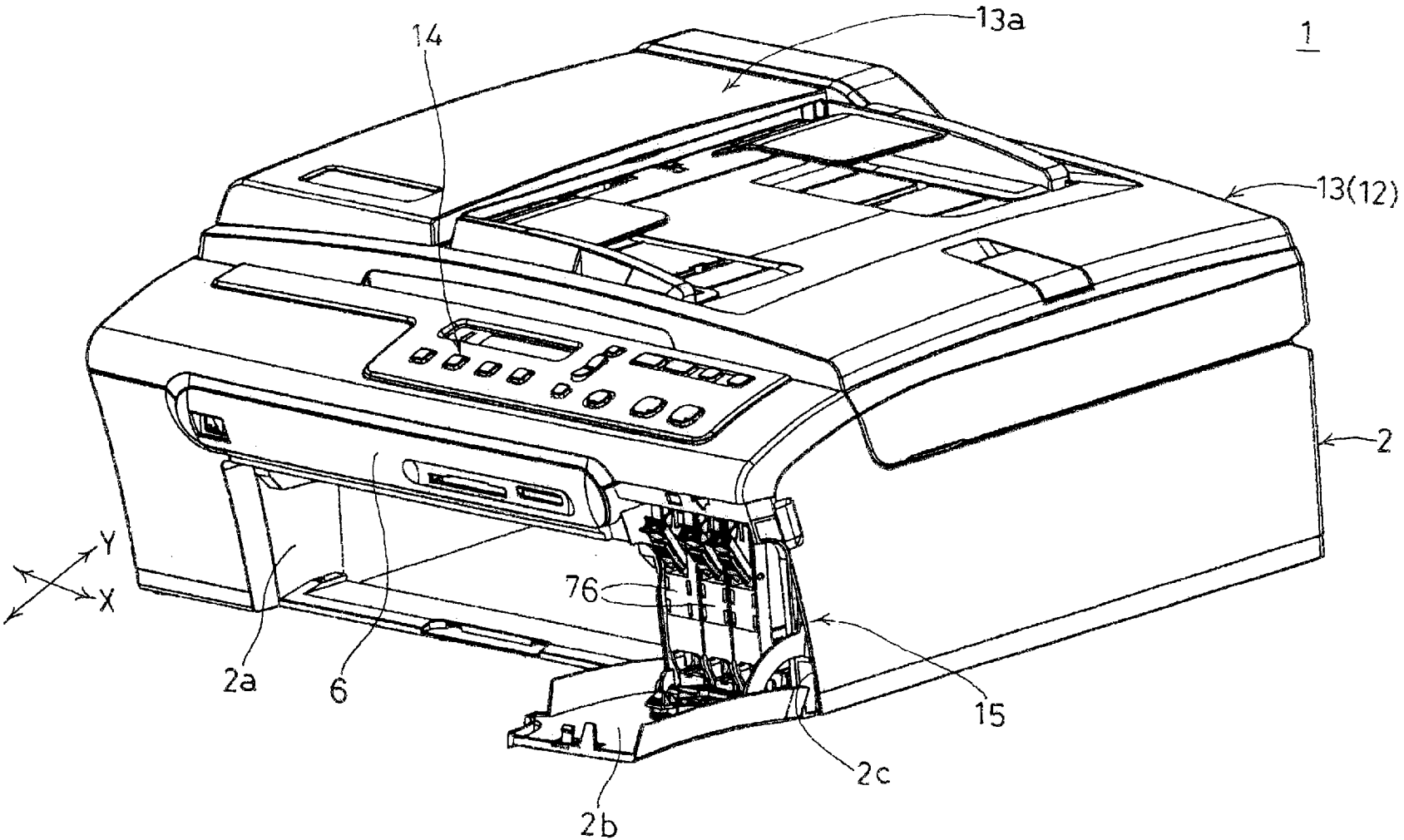
FIG. 1 shows a perspective view of a multi-function device of the present embodiment.

FIG. 1 shows a perspective view of a multi-function device of the present embodiment. As shown in FIG. 1, the present invention is incorporated into a multi-function device 1 (it may also be referred to as MFD 1 in the description below) in the present embodiment. The MFD 1 comprises printing function, scanning function, copying function, facsimile function, etc. The MFD 1 is connected to a computer not shown in the figures, and operates the above-mentioned functions according to the orders and data sent therefrom. The MFD 1 is also able to connect to an external device, such as a digital camera, and perform printing functions according to the orders and data sent therefrom.

In the descriptions below, the expressions regarding the front and rear directions (that is, the direction corresponding to the Y axis in FIG. 1) will be described with respect to the side where the opening 2*a* of the housing 2 is defined as the front side. The expressions regarding the left and right directions (that is, the direction shown with X axis in FIG. 1) will be described with respect to the front view of the MFD 1.

The MFD 1 comprises a box-shaped housing 2 made of synthetic resin. At the front side of the housing 2, a slot member 6 to insert memory devices is arranged. The MDF 1 can operate its printing function according to the data stored therein.

Above the slot member 6, an operation panel 14 is situated on the upper front part of the housing 2. The operation panel 14 comprises operation buttons and a LCD monitor. Operation orders can be inputted by manually operating the operation panel 14.

A scanner 12 is fixed on the upper part of the housing 2 of the MFD 1. The scanner 12 is utilized in operating functions such as the copying function and the facsimile function.

On the top surface of the scanner 12, a glass plate (not shown in the figures) is arranged, and a Contact Image Sensor (CIS, not shown in the figures) is installed underneath the glass plate. The CIS is able to move in the leftward and rightward direction, that is, the direction shown with axis X in FIG. 1.

The scanner 12 has a scanner cover 13 arranged on the top. The scanner cover 13 is hingedly connected to the main body of the scanner 12 at the rear edge. The scanner cover 13 can rotate with respect to the glass surface between a closed state that the scanner cover 13 covers the glass plate, and an opened state that the glass plate is exposed. The scanner cover 13 also includes an auto document feeder (ADF) 13*a*.

Figure 3:
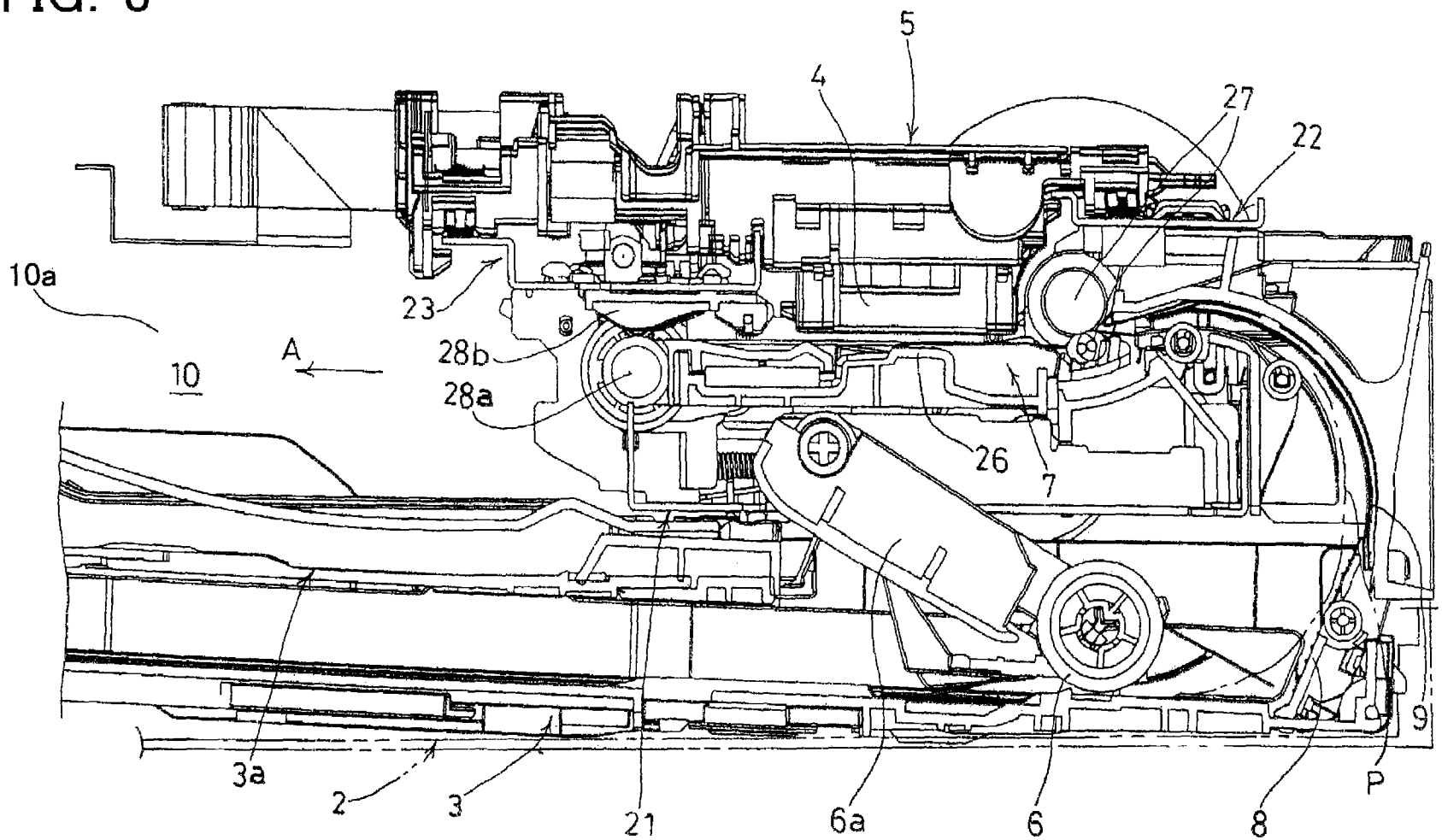
FIG. 3 shows a cross sectional view of a printer.

At the lower part of the housing 2 that is shown in FIG. 1, a printer 7 is arranged below the scanner 12. And, below the printer 7, a paper feeding mechanism is arranged. FIG. 3 shows a cross sectional view of the printer 7 and the lower part of the housing 2. As shown in FIG. 3, at the bottom part inside the housing 2, a space for storing the paper feed-in cassette 3 is provided. This space has an opening 2*a* located at the front side of the housing 2 (also see FIG. 1). The paper feed-in cassette 3 can be inserted into and detached from the housing 2 from the front side through the opening 2*a* in the horizontal direction with respect to the bottom surface of the housing 2.

In the present embodiment, the paper feed-in cassette 3 is able to store printing paper P of various sizes, such as the A4 size, letter size, legal size, postcard size, etc. in a stacked state.

On the upper part of the paper feed-in cassette 3, a secondary feed-in cassette 3*a* is arranged. The secondary feed-in cassette 3*a* can store stacks of paper of small sizes, and is slidable, in the Y-axis direction, on the paper feed-in cassette 3. The paper feed-in cassette 3 and the secondary feed-in cassette 3*a* shown in FIG. 3 are abbreviated in FIG. 1.

The printing paper P fed from the stack in the paper feed-in cassette 3 is fed through the U-shaped passage 9 (that is, the paper feeding passage) in the upper direction. The printing paper P is fed into the printer 7, which is located on the upper rear part of the housing 2 and above the paper feed-in cassette 3. The printer 7 operates the printing function, and prints images on the printing paper P by discharging ink thereon.

After the printing paper P is conveyed through the printer 7, and an image is printed thereon, the printing paper P is fed out onto a paper feed-out member 10. The paper feed-out member 10 is located above the paper feed-in cassette 3. The paper feed-out member 10 includes a feed-out opening 10*a*. The feed-out opening 10*a* is included in the front opening 2*a* as the upper part thereof.

As shown in FIG. 1, next to the front opening 2*a*, an ink cartridge storage unit 15 is arranged. The ink cartridge storage unit 15 is fixed to the bottom surface of the main body. Furthermore, a cover 2*b* for the ink cartridge storage unit 15 is hinged to the housing 2. The cover 2*b* is connected to the housing 2 with a hinge that connects a bottom edge of the cover 2*b* and a part of the lower front side of the housing 2. As shown in FIG. 1, the cover 2*b* can rotate with respect to the ink cartridge storage unit 15 between a closed state that the cover 2*b* covers the ink cartridge storage unit 15, and an opened state that the ink cartridge storage unit 15 is exposed. The ink cartridge storage unit 15 is connected to the printer 7 with a relaying member to provide ink thereto.

Figure 2:
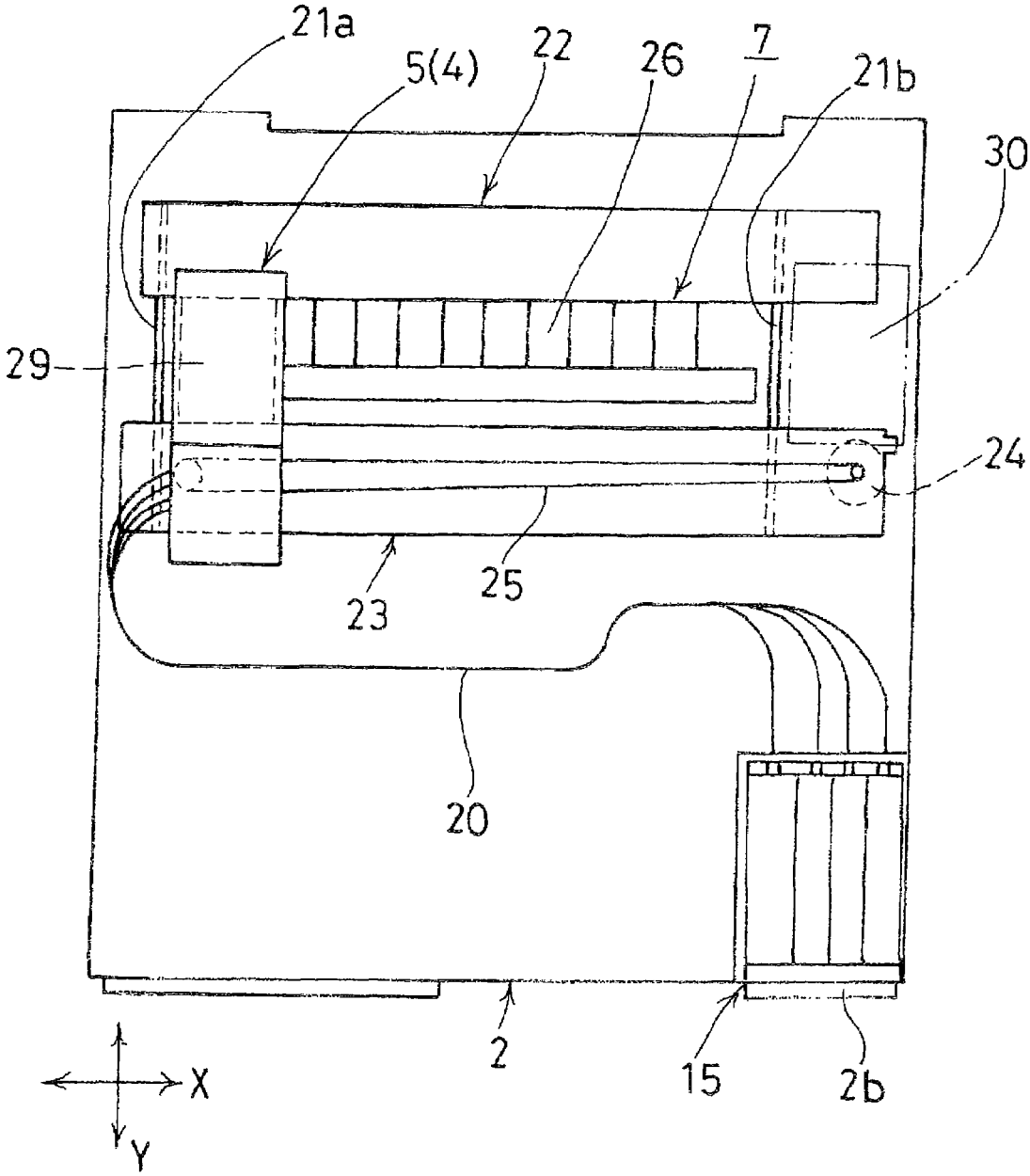
FIG. 2 shows a plane view of a housing (main body) with the upper case removed.

FIG. 2 shows a plane view of the lower part of the housing 2 with the upper part (the scanner 12) removed. The printer 7 is connected to the ink cartridge storage unit 15 by a plurality of ink tubes 20. The ink stored inside the ink cartridge storage unit 15 is provided to the printer 7 through the ink tubes 20. Each ink tube 20 is arranged to provide ink of one color type; that is, as shown in FIG. 2, FIG. 4 and FIG. 5, four types of ink are stored in the ink cartridge storage unit 15 in the present embodiment.

Figure 4:
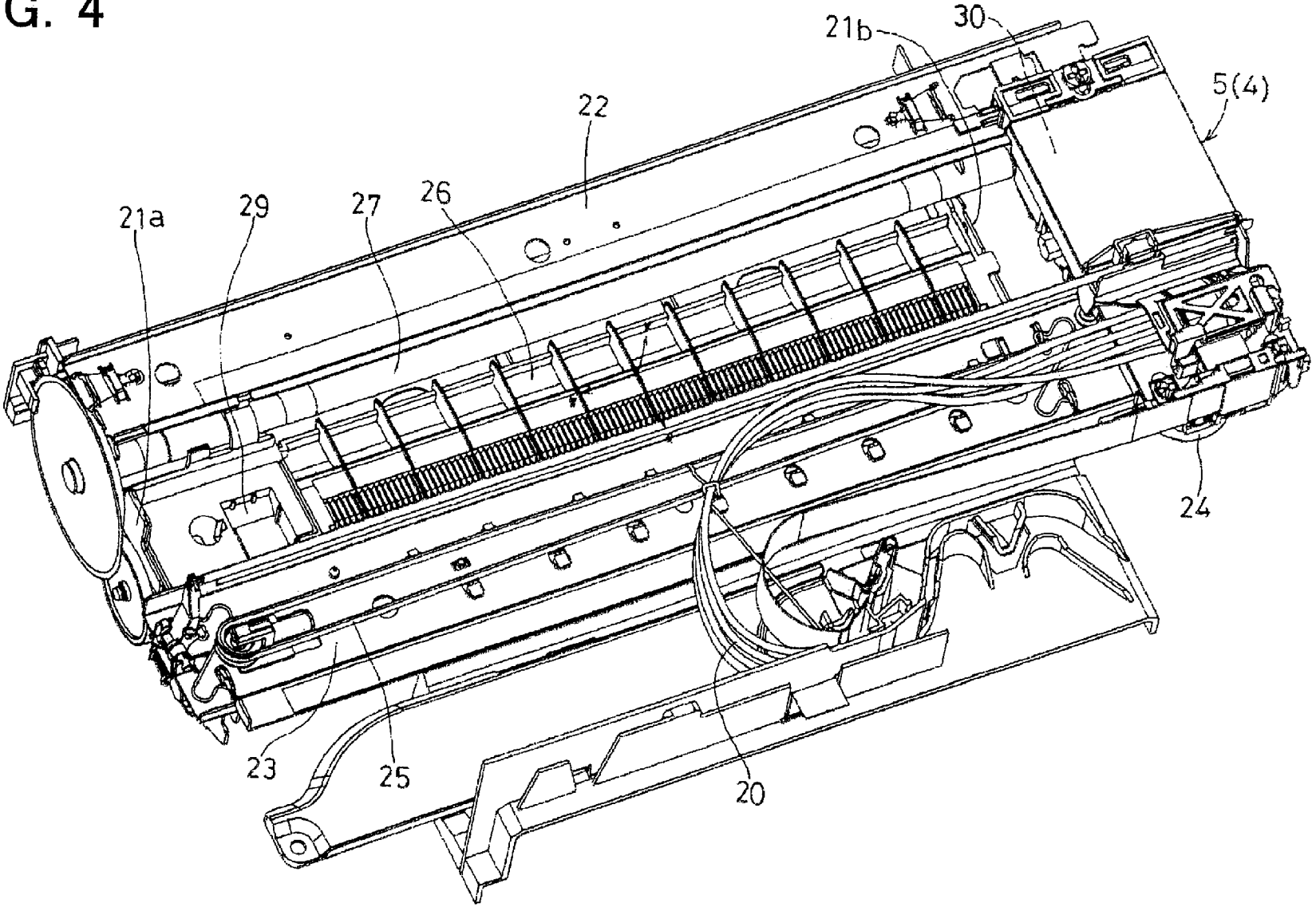
FIG. 4 shows a perspective view of a printer.
Figure 5:
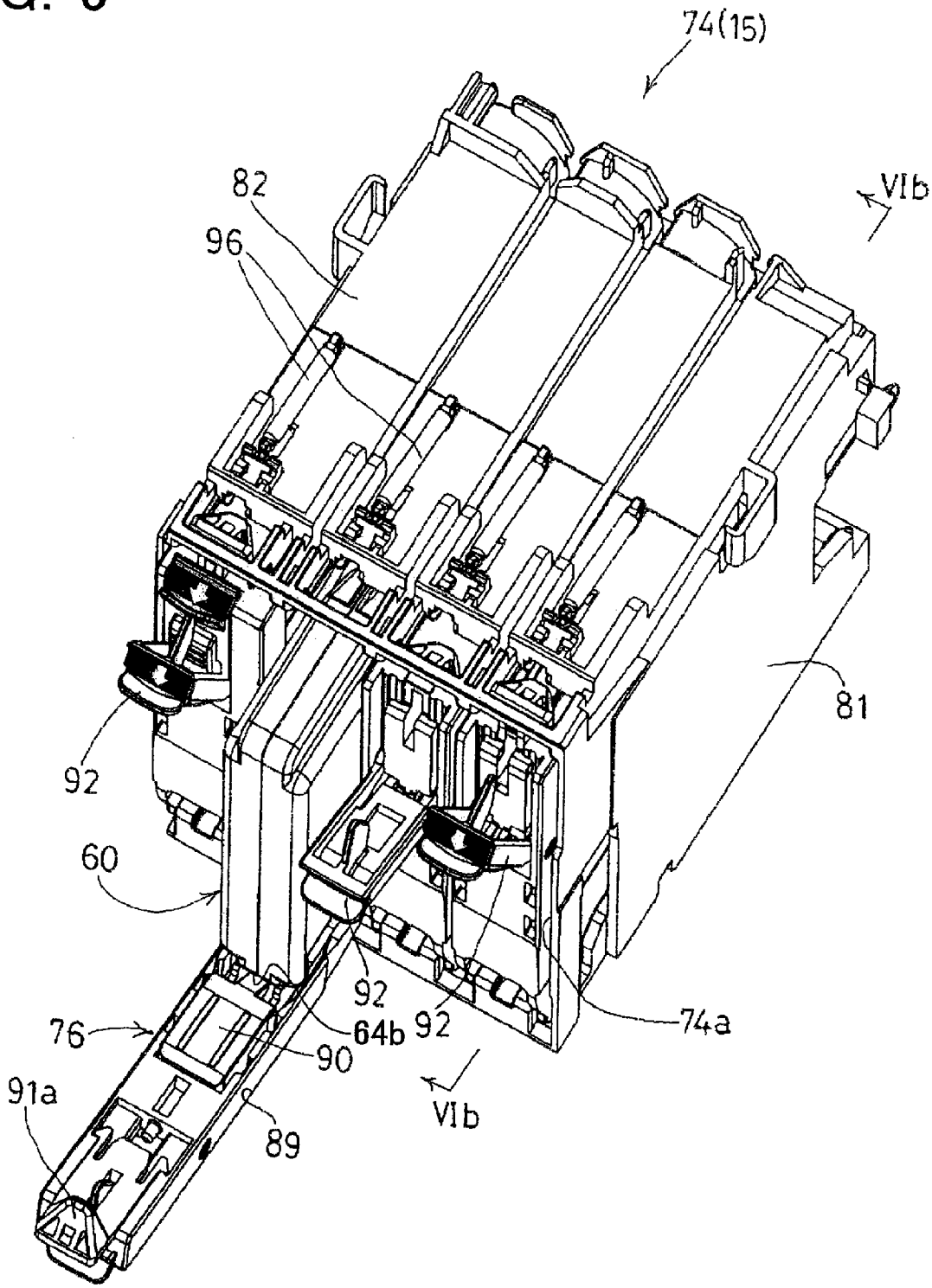
FIG. 5 shows a perspective view of an ink cartridge storage unit.

FIG. 4 shows a perspective view of the printer 7. As shown in FIG. 2 and FIG. 4, the printer 7 is supported by a main frame 21. More specifically, the printer 7 is supported by a pair of side plates 21*a* and 21*b* of the main frame 21, which are located on the left and right side respectively. The printer 7 further includes a first guiding member 22 and a second guiding member 23. The first and second guiding members 22, 23 are flat plates that extend in the direction of axis X (shown in FIG. 1). The first and second guiding members 22, 23 slidably support a carriage 5. The carriage 5 includes a print head 4, and is configured so that it is able to slide back and forth in the direction of axis X. The carriage 5 is moved by a timing belt 25 and a carriage motor (CR motor) 24. The timing belt 25 is a loop belt wound around a pulley, and it is extending above and parallel to the second guiding member 23. A part of the timing belt 25 is fixed to the carriage 5. The driving force from the CR motor 24 is transmitted to the timing belt 25 through the pulley; thus the carriage 5 is driven by the driving force from the CR motor 24. In the present embodiment, the CR motor 24 is a DC motor. However, it can be substituted by other types of motors (a stepping motor, for example).

Under the print head 4 and between the first and second guiding members 22, 23, a platen 26 is arranged. The platen 26 has the shape of a flat rectangular plate, and it supports the sheet of printing paper P that is conveyed underneath the print head 4. The first guiding member 22 is located on the upstream side and the second guiding member is located on the downstream side with respect to the direction the sheet of printing paper P is conveyed (that is, the direction shown with arrow A in FIG. 3).

A pair of resist rollers 27 is arranged along the widthwise direction of the platen 26. The pair of resist rollers 27 is located on the first guiding member 22 side with respect to the direction of axis Y. As shown in FIG. 3, the pair of resist rollers 27 feed the sheet of printing paper P in between the platen 26 and the print head 4.

On the downstream side of the platen 26, a feed-out roller 28*a* and a spur roller 28*b* are arranged. After being conveyed underneath the print head 4, the sheet of printing paper P is fed out to the paper feed-out member 10 by the feed-out roller 28*a* and the spur roller 28*b*.

Furthermore, as shown in FIGS. 2 and 4, an ink receptor 29 is arranged on one side of the platen 26, and a maintenance unit 30 is arranged on the other side of the platen 26. In the present embodiment, the ink receptor 29 is arranged between the side plate 21*a* and the platen 26, and the maintenance unit 30 is arranged on the right side of the side plate 21*b*. The ink receptor 29 is utilized as a flushing position for the print head 4. The print head 4 (or the carriage 5) periodically slides to the flushing position, that is, above the ink receptor 29, during the printing operation in order to discharge ink for the purpose of preventing nozzle clog. The ink receptor 29 receives the ink discharged therefrom.

The maintenance unit 30 is utilized for a stand by position for the carriage 5. The maintenance unit 30 is operated in processes such as a process for selectively absorbing ink of different colors, a recovery process for removing air bubbles from a buffer tank (not shown in the figures) arranged above the print head 4, and/or the like.

Though not shown in the figures, the maintenance unit 30 further includes a wiper member. The wiper member cleans the nozzle surface of the print head 4 when the carriage 5 slides into the printing region (that is, above the platen 26) from the stand by position.

The configuration of the ink cartridge storage unit 15 will be described below. FIG. 5 shows a perspective view of the ink cartridge storage unit 15. The ink cartridge storage unit 15 includes a storage main body 74 for storing a plurality of ink cartridges 60. In the present embodiment, four ink cartridges 60 can be stored, aligned in parallel, in the direction of axis X inside the storage main body 74. Four storage covers 76 are connected to the lower front part of the storage main body 74. Each storage cover 76 rotates with respect to the main body 74 between an opened state (shown with the second storage cover 76 to the left in FIG. 5), and a closed state (shown with the storage covers 76 in FIG. 12A).

Figure 6A:
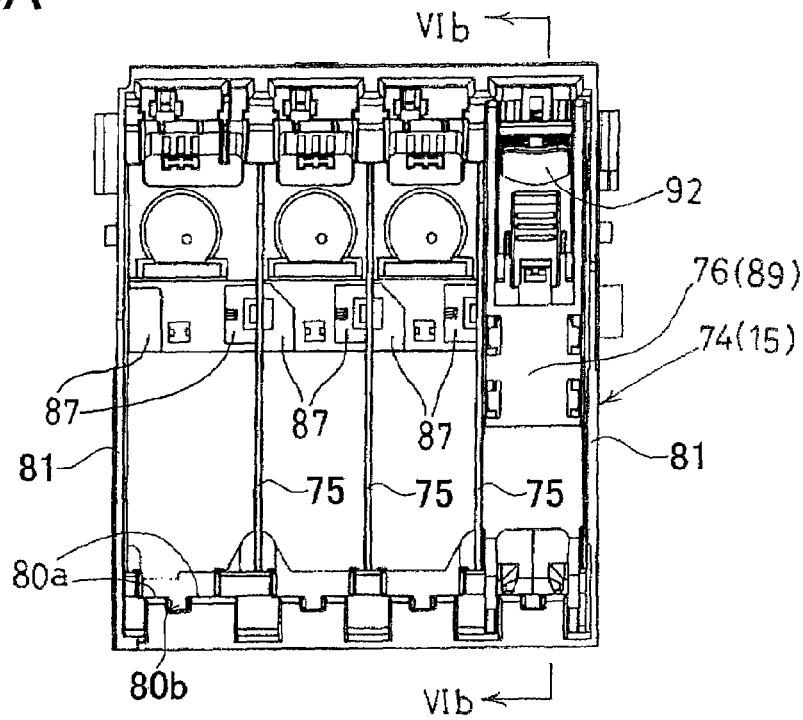
FIG. 6A shows a front view of an ink cartridge storage unit.
Figure 6B:
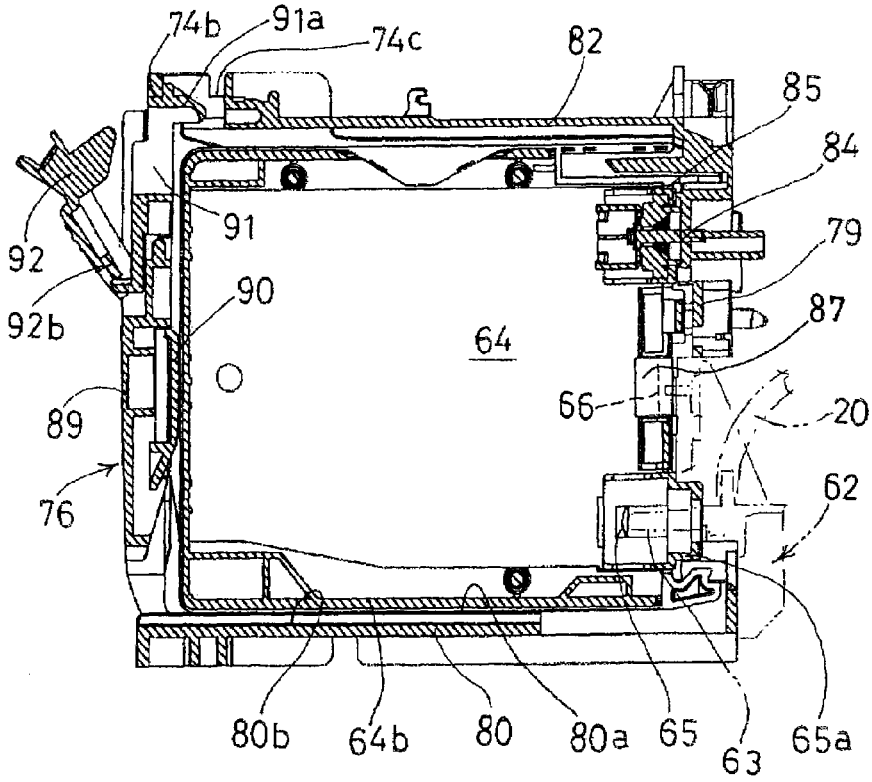
FIG. 6B shows a cross sectional view along the line VIb-VIb of FIG. 5.

The storage main body 74 of the ink cartridge storage unit 15 is made of resin, for example, in a rectangular parallelepiped shape. FIG. 6A shows a front view of the ink cartridge storage unit 15, and FIG. 6B shows a cross sectional view along the line VIb-VIb of FIG. 5. As shown in FIGS. 5, 6A and 6B, the storage main body 74 includes a bottom plate 80, a pair of side plates 81, a top plate 82, and a rear plate 79. The side plates 81 are vertically connected to the bottom plate 80, and the top plate 82 is attached on top of the side plates 81. The side plates 81 are connected by the rear plate 79, which is arranged at the upper part (a part close to the top plate 82) of the rear wall. The front part of the storage main body 74 has an opening 74*a*, where the ink cartridges 60 can be inserted or removed therefrom. Inside the storage main body 74, as shown in FIG. 6, a plurality of separators 75 is arranged (also see FIGS. 9, 11 and 12B). The separators 75 divide the space inside the storage main body 74 into several storage rooms 78, into which the ink cartridges 60 can be installed respectively. Depending on the number of ink cartridges 60, a corresponding number of separators 75 are arranged inside the storage main body 74.

In the present embodiment, the storage main body 74 has four storage rooms 78. Each storage room 78 is configured so that the corresponding ink cartridge 60 can be inserted and removed from the front side opening 74*a*. Thus, the four cover cartridges 76 correspond to each storage room 78. The interior surfaces of the storage room 78 are formed to fit with the corresponding surfaces of the ink cartridge 60. Due to this configuration, the ink cartridge 60 can be stored stably in the storage room 78.

The separator 75 does not need to distinctly divide the storage rooms 78. The separator 75 can be formed to separate the storage rooms 78 at least at the rear side (the side close to the rear plate 79) in the form of ribs dividing the adjacent storage rooms 78. It is preferred that the bottom plate 80, the side plates 81, the top plate 82, the rear plate 79 and the separator 75 to be formed as one component.

In the present embodiment, as clearly shown in FIGS. 6A and 6B, the storage room 78 has a pair of guiding rails 80*a* arranged at the surface of the bottom plate 80. Each guiding rail 80*a* has a flat surface, and the ink cartridge 60 is placed thereon. The guiding rails 80*a* extends from the front opening 74*a* towards the rear plate 79, and guides the ink cartridge 60 along that direction in the course of inserting and removing the ink cartridge 60 from the storage main body 74. Moreover, a groove 80*b* is formed between the pair of guiding rails 80*a*. In a case where the ink leak occurs, the groove 80*b* between the pair of guiding rails 80*a* is utilized as a drain for the leaking ink.

Figure 7A:
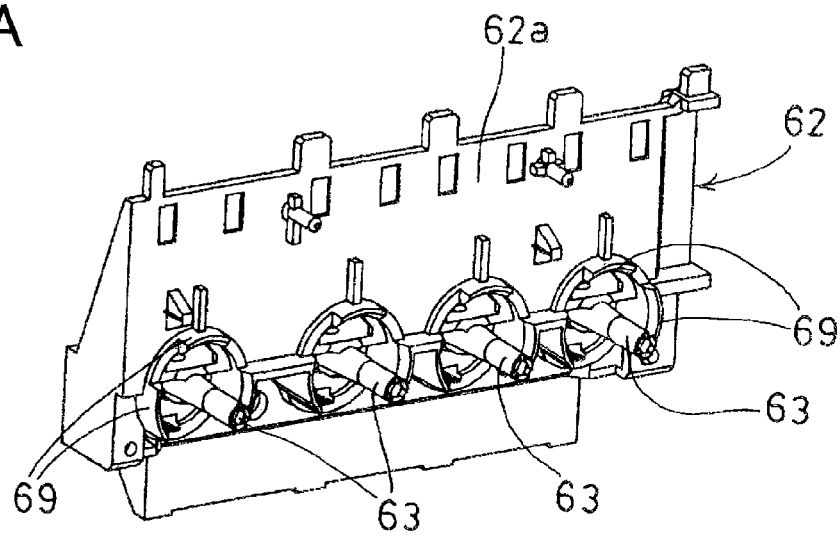
FIG. 7A, FIG. 7B and FIG. 7C show perspective views of a connector from different angles.
Figure 7B:
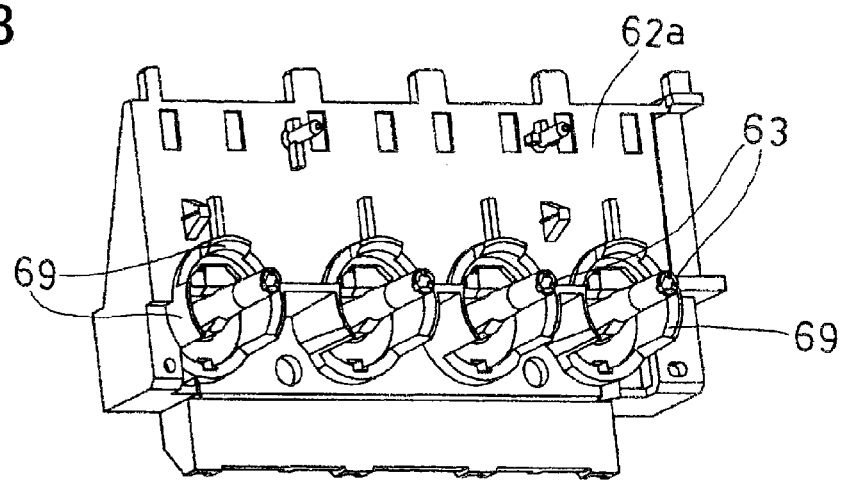
Figure 7C:
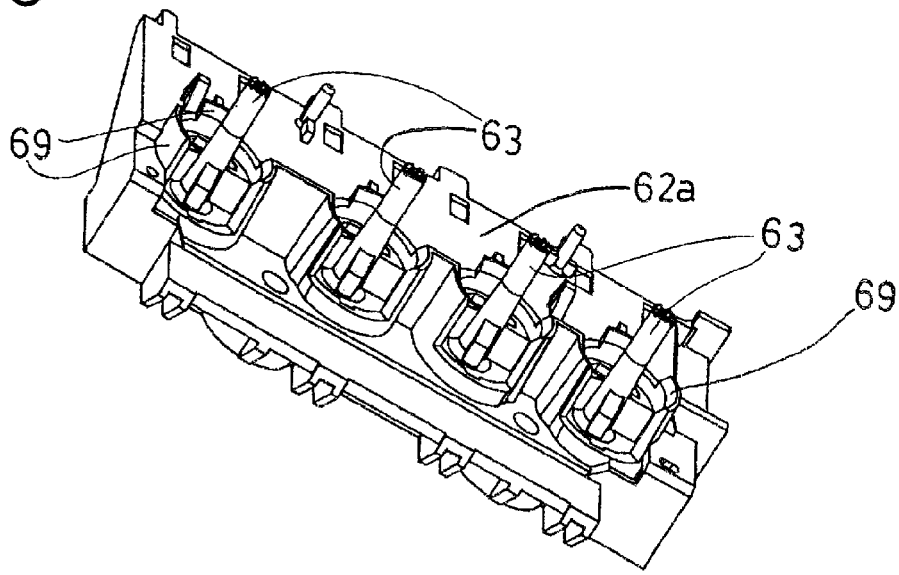

Furthermore, as shown in FIG. 6B, the cartridge storage unit 15 includes a connector 62. The connector 62 connects the ink cartridge 60 and the ink tube 20. FIG. 7A, FIG. 7B and FIG. 7C show perspective views of the connector 62 from different angles. The connector 62 includes a rectangular plate 62*a*, and a plurality of ink inducing tubes 63. The ink inducing tube 63 is in the shape of a needle or a tube, and is formed in unity with and penetrating through the rectangular plate 62*a*. The ink inducing tube 63 is connected to one end of the ink tube 20, as shown in FIG. 6B. The other end of the ink tube 20 is connected to the print head 4 of the carriage 5 (see FIG. 2), and is configured to provide the ink to the print head 4. The rectangular plate 62*a* fixedly covers the lower part of the rear plate 79 of the storage main body 74, and the other end of the ink inducing tube 63 (the protruding part shown in FIGS. 7A, 7B and 7C), vertically protrudes inside the storage main body 74 with respect to the rear plate 79. A plurality of arc-shaped guiding ribs 69 is arranged on the outer periphery of the ink inducing tube 63. The guiding ribs 69 are utilized to guide the ink cartridge 60 in the course of connecting the ink cartridge 60 to the ink inducing tube 63.

In the present embodiment, the four aforementioned ink colors are utilized. Therefore, four sets of ink inducing tubes 63 and ink tubes 20 are arranged. The number of the sets can be configured to correspond to the number of ink cartridges 60 utilized for the printer 7. For example, in a case where six to eight different colors are used, the ink cartridge storage unit 15 is configured to store six to eight ink cartridges, and a corresponding number of ink inducing tubes 63 and ink tubes 20 are arranged.

The configuration of the ink cartridge 60 will be described below. As shown in FIG. 5 and 6B, the ink cartridges 60 each includes a cartridge main body 64 made of synthetic resin. As is clear from FIG. 6A, the cartridge main body 64 and has the shape of a rectangular box whose front view area (its width) is narrow, and the vertical height is long. The cartridge main body 64 is formed as a rectangular parallelepiped box with thin walls, and a space for storing ink cartridges is formed therein. The cartridge main body 64 is composed of two tray shaped members. The two tray members are welded or adhered to compose the left and right side of the main body 64. The width of the cartridge main body 64 is defined by the distance between two walls parallel to the direction of axis Y.

As described above, the ink cartridge storage unit 15 of the present embodiment is able to store four ink cartridges 60 of different colors, each holding different colors of ink: black (BK), cyan (C), magenta (M) and yellow (Y). When the ink cartridges 60 are installed inside the storage main body 74, they can be arranged parallel in the aforementioned color order. Furthermore, as clearly shown in FIG. 1, FIG. 5 and FIG. 6A, the ink cartridge 60 for BK ink is larger than the other ink cartridges 60 in the widthwise direction (the direction of axis Y). Such a configuration is based on the fact that the demand for black ink exceeds the demands for other colors, thus the black ink is consumed most. In the present embodiment, the construction and configuration of the ink cartridges 60 for colors other than black is identical.

At the rear side of the main body 64 (the side facing the rear plate 79 of the storage main body 74), an air valve 85 is arranged on the upper part (see FIG. 6B). In the present embodiment, a checking valve (not shown in the figures) is installed inside the air valve 85. Furthermore, a pushing rod 84 is connected to the air valve 85. The pushing rod 84 protrudes towards the inserting direction of the ink cartridge 60. The pushing rod 84 is able to move in the inserting direction between a state of protruding outside the air valve 85 and a state of being pushed back inside the air valve 85. When the ink cartridge 60 is inserted into the storage main body 74, and the rear side surface of the ink cartridge 60 makes contact with the rear plate 79, the pushing rod 84 is pushed back inside the air valve 85. As a result, the checking valve inside the air valve 85 opens. When the ink cartridge 60 is removed from the storage main body 74, that is, when the rear surface of the cartridge main body 64 is pulled away from the rear plate 79, the pushing rod 84 is brought out into the state of protruding outside the air valve 85. The checking valve is closed as the result of the pushing rod 84 being pulled out of the air valve 85.

Furthermore, at the lower part of the rear side surface of the cartridge main body 64, an ink inducing valve 65 is arranged. The ink inducing valve 65 is arranged inside a guiding tube 65*a* (see FIG. 6B). In the course of inserting the ink cartridge 60 into the storage main body 74, the guiding ribs 69 of the connector 62 guide the ink inducing valve 65 during the course of the insertion. As the result of the insertion, the arc shaped guiding ribs 69 are engaged with the outer periphery of the guiding tube 65*a*. Thus, the ink inducing valve 65 of the ink cartridge 60 and the ink inducing tube 63 of the ink cartridge storage unit 15 are connected. Ink is provided from the ink cartridge 60 to the print head 4 through the aforementioned connection of the ink inducing valve 65 and the ink inducing tube 63, and through the ink tube 20 connected to the ink inducing tube 63.

As shown in FIG. 6B, on the rear side surface of the cartridge main body 64, a sensed portion 66 is arranged. Inside the cartridge main body 64, a movable device not shown in the figures that can function as a sensed actuator is arranged. The actuator is able to move in accordance with the amount of ink remaining inside the cartridge main body 64.

On the other hand, the storage main body 74 includes a liquid level sensor 87 (for example, a photo interrupter). The liquid level sensor 87 is arranged on the rear side surface of the main body 74, at a place where the liquid level sensor 87 is able to detect the movement of the actuator via the sensed portion 66. The liquid level sensor 87 detects whether the actuator is within the sensing range, and monitors the level of ink remaining.

Figure 9:
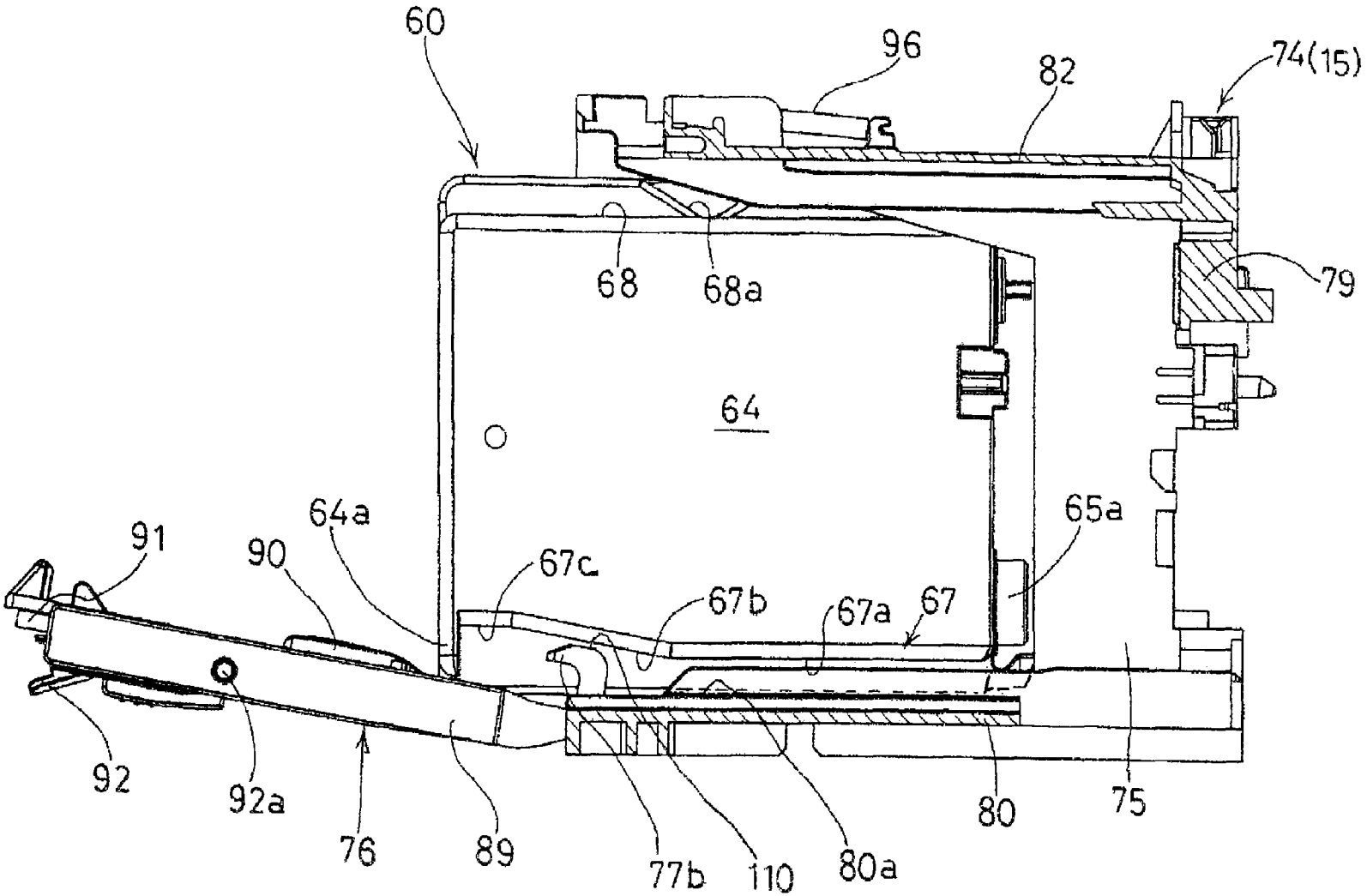
FIG. 9 shows a cross sectional side view of an ink cartridge being removed from an ink cartridge storage unit.

As shown in FIG. 9, a groove 68 is formed at the top surface of the cartridge main body 64. The groove 68 extends in the lengthwise direction of the cartridge main body 64. Furthermore, a concave portion 68*a* is formed in an approximately intermediate area of the groove 68. The concave portion 68*a* is a v-shaped indentation, including the angled surfaces at the front side and the rear side respectively.

The aforementioned L-shaped swing arm (not shown) arranged on the top plate 82 of the storage main body 74 is guided along the groove 68 in the course of installing and removing the ink cartridge 60 from the storage main body 74. In the course of removing the ink cartridge 60 from the storage main body 74, the ink cartridge 60 is slightly pulled out of the storage room 78 by the rotation of the storage cover 76. Then, when the distal end of the swing arm is engaged with the concave portion 68*a*, the ink cartridge 60 is further pushed out to a position, for example, as shown in FIG. 9 by the force transmitted from the swing arm.

Figure 8:
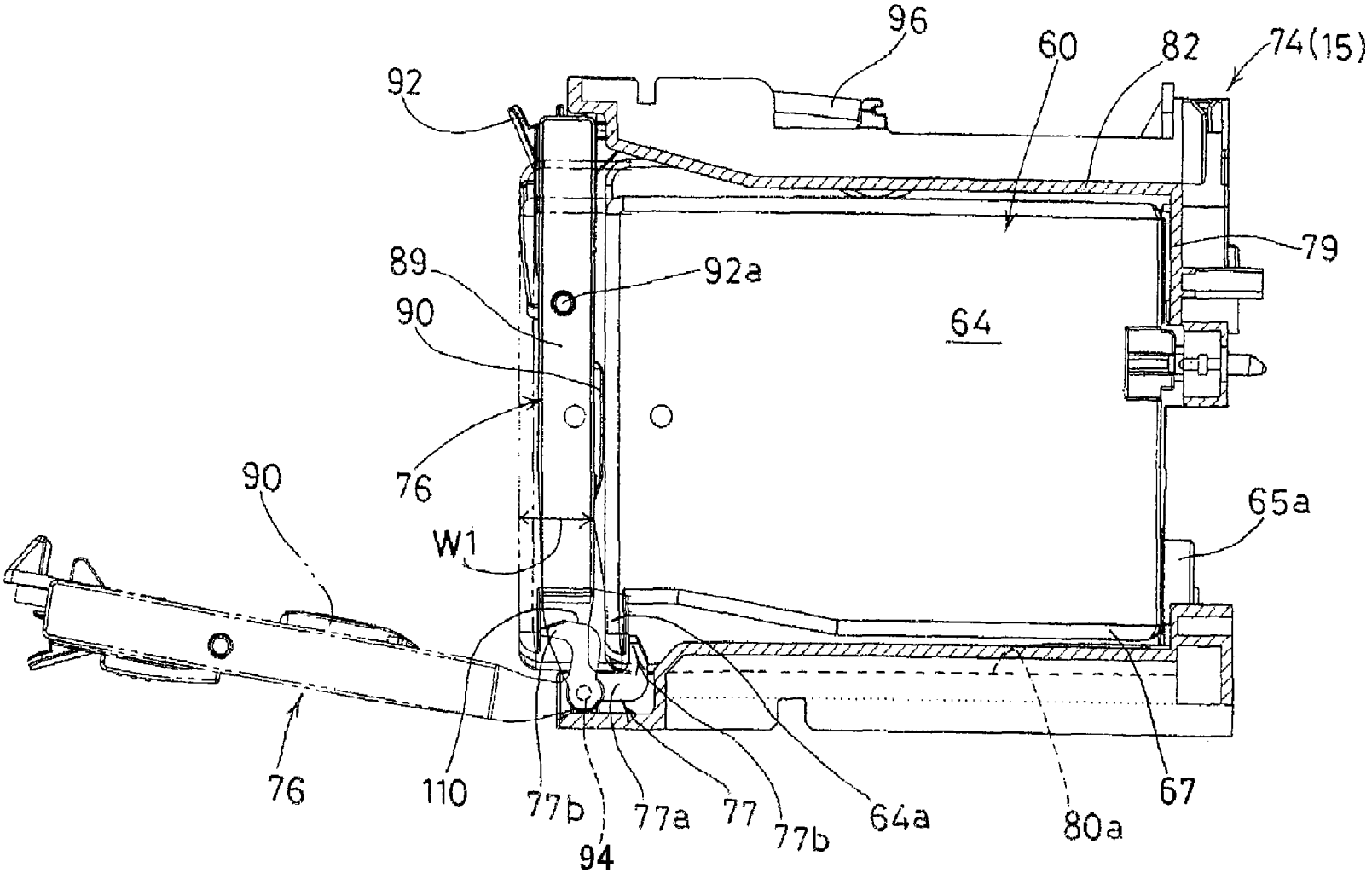
FIG. 8 shows a cross sectional side view of an ink cartridge installed in an ink cartridge storage unit.

Furthermore, as shown in FIG. 8 and FIG. 9, on the bottom surface of the cartridge main body 64, guiding grooves 67 are arranged. The guiding grooves 67 extend along the insertion direction; that is, the lengthwise direction of the cartridge main body 64. Each guiding groove 67 is concavely formed in the boundary corner of the bottom surface and the side surface of the main body 64 (also see FIG. 5).

In the present embodiment, the guiding grooves 67 are formed in the left and right corners respectively. As shown in FIG. 9, the guiding groove 67 includes a first portion 67*a*, a second portion 67*b*, and a third portion 67*c*. The first portion 67*a* is a shallowly concaved groove. One end of the first portion 67*a* is open towards the rear side surface of the storage main body 74, when the ink cartridge 60 is installed in the storage main body 74. The second portion 67*b* is arranged in between the first portion 67*a* and the third portion 67*c*. The second portion 67*b* is a groove whose size enlarges towards the third portion 67*c*; that is, the depth of the second portion 67*b* deepens towards the third portion 67*c*. The groove of the third portion 67*c* is the deepest of the aforementioned portions 67*a*, 67*b* and 67*c*. The bottom surface of the third portion 67*c* is parallel to the remaining bottom surface 64*b*, that is the surface areas in which grooves have not been formed, of the cartridge main body 64. The distal end of the third portion 67*c* is covered by a hook member 64*a*, so that the groove 67 is not open towards the front side of the storage main body 64 (that is, the front opening 74*a* side of the ink cartridge storage unit 15). Therefore, the left and right corners of the bottom surface of the cartridge main body 64 are both curtailed by the guiding grooves 67, with the bottom surface 64*b* remaining (see FIG. 5 and FIG. 6B).

In the course of installing the ink cartridge 60, the bottom surface 64*b* is placed on the aforementioned guiding rails 80*a*, and guided thereon. The height position of the guiding rails 80*a* is configured so that the ink inducing tube 63 can be inserted into the ink inducing valve 65.

When the ink cartridge 60 is installed inside the storage room 78, the pushing rod 84 is pressed against the rear plate 79 and releases the air valve 85 of the ink cartridge 60. The liquid level sensor 87 is engaged with the sensed portion 66 of the ink cartridge 60. Such configuration enables air to be induced into the cartridge main body 64 via the air valve 85, and the ink stored inside the cartridge main body 64 flows out to the print head 4 side.

Figure 11:
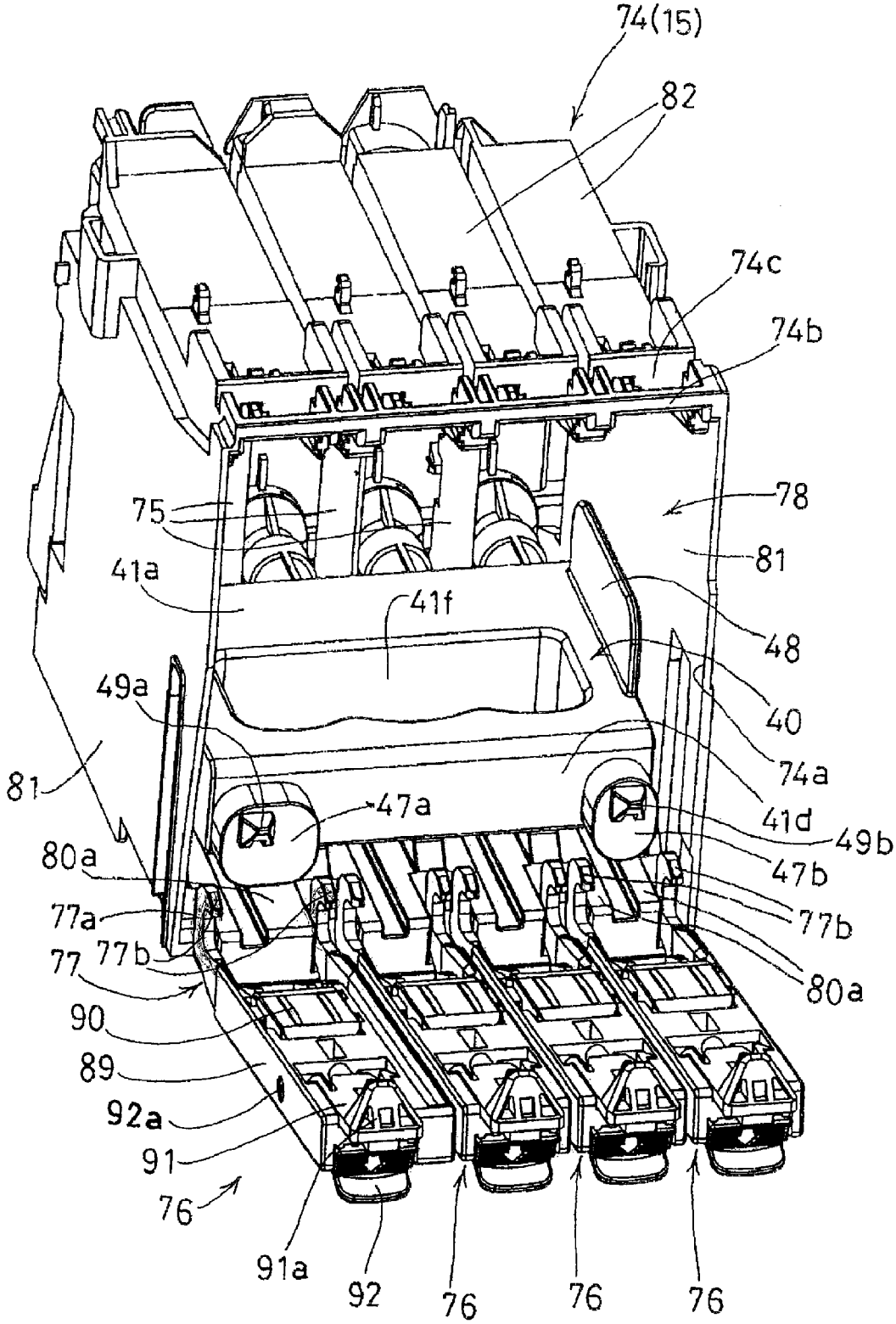
FIG. 11 shows a perspective view of a protection device installed in an ink cartridge storage unit.

As shown in FIG. 5 and FIG. 11, at the front opening 74*a* of the main body 74, the plurality of storage covers 76 are arranged. Each storage cover 76 corresponds to one of the storage rooms 78. The storage covers 76 are made of materials such as synthetic resin.

As shown in FIG. 9, the storage cover 76 is connected to the lower edge of the storage main body 74 with a shaft 94. The storage cover 76 can rotate with respect to the storage main body 74 between the opened state and the closed state (see FIG. 5). In the opened state, the ink cartridges 60 can be inserted or removed through the front opening 74*a*. In the closed state with the ink cartridges 60 installed, the storage covers 76 hold the ink cartridges 60 at a stable position.

As clearly shown in FIG. 9, the storage cover 76 includes a cover main body 89, a weight support member 90, a lock member 91, and a lock release lever 92. The aforementioned components are made of synthetic resin.

On the lower end (the end connected to the storage main body 74) of the cover main body 89, a pair of lever members 77 is formed on the left and right side respectively (see FIG. 8). The pair of lever members 77, which is equivalent to a pair of projections, are projecting horizontally with respect to the interior side surface of the cover main body 89. The lever member 77 includes an elongated portion 77*a* and a curved portion 77*b*. One end of the elongated portion 77*a* is connected to the cover main body 89, and is extending in an orthogonal direction with respect to the cover main body 89. Simultaneously, the curved portion 77*b* is connected to the other end of the elongated portion 77*a*, and is extending therefrom. The curved portion 77*b* curves at an angle of 90 degrees from the elongated portion 77*a*. In the closed state, the distal end of the curved portion 77*b* is protruding higher in the upper direction than the top surfaces of the guiding rails 80*a*. Thus, as shown in FIG. 8, the hook member 64*a* of the ink cartridge 60 is caught by the curved portion 77*b*. In the course of opening the storage cover 76, the cover main body 89 and the lever member 77 are rotated frontward (that is, the direction of Y axis in FIG. 1). The curved portion 77*b* slightly pulls out the ink cartridge 60 from the storage room 78 with the rotation of the curved portion 77*b*, as the shifting of the hook member 64*a* accompanies the aforementioned rotation. In FIG. 8, the amount of shifting of the ink cartridge 60 is shown as W1. The dotted line of FIG. 8 shows the opened state of the storage cover 76 and the ink cartridge 60 after being slightly pulled out of the storage room 78.

As shown in FIG. 8, in the process of the storage cover 76 shifting to the opened state, the curved portion 77*b* of the lever member 77 rotates in counter clockwise direction with respect to the shaft 94. The rotation turns an exterior surface 110 of the lever member 77 from a vertically standing state to a near-horizontal state with respect to the surface of the bottom plate 80. The elongated portion 77*a* of the lever member 77 is configured in a certain length size, so that the exterior surface 110 is positioned slightly higher than the surface of the guiding rails 80*a*. In this case, the exterior surface 110 guides the ink cartridge 60 being inserted into the storage room 78 onto the guiding rails 80*a*. This means that the lever member 77 functions as a component that pulls out the ink cartridge 60 from the storage room 78 in the removing process, and as a component that guides the ink cartridge 60 into the storage room 78 in the inserting process (see FIGS. 8 and 9).

Though not shown in the figures, a swing arm is arranged on the surface of the top plate 82 of the storage main body 74. The swing arm has an L-shape from the side view, and is attached to the ceiling of each storage room 78 with a spring 96 (shown in FIGS. 5 and 8). When the ink cartridge 60 is installed inside the storage room 78, the swing arm holds the ink cartridge 60 down in the vertical direction with respect to the bottom plate 80. This means that a repulsing force from the ink cartridge 60 is exerted on the spring 96 during such state. FIG. 8 shows a cross sectional side view of the ink cartridge 60 installed in the ink cartridge storage 15, and FIG. 9 shows a cross sectional side view of the ink cartridge 60 being removed from the ink cartridge storage 15. When the storage cover 76 is opened, the ink cartridge 60 is pulled out to the position shown with dotted line in FIG. 8. Then, the ink cartridge 60 is further withdrawn to a position, for example, shown in FIG. 9, by the force transmitted from the swing arm.

As shown in FIGS. 5, 6B, 8, 9, 11, and 12B, the weight support member 90 is arranged on the interior surface (the surface side which faces the storage room 78 in the closed state) of the cover main body 89. The weight support member 90 is suspended on the cover main body 89 with a compressed coil spring (not shown in the figures) so as to maintain a protruding posture. The weight support member 90 may be configured so that it may sink into the interior surface when it is pressed in that direction. Hence, when the storage cover 76 is in its closed state with the ink cartridge 60 installed inside the storage main body, the weight support member 90 is making contact with the front side surface of the ink cartridge 60. The weight support member 90 presses against the ink cartridge 60 in a vertical direction with respect to the interior surface of the cover main body 89, and holds the ink cartridge 60 in a predetermined position inside the storage room 78.

The lock member 91 is slidably arranged at the upper end of the cover main body 89. The lock member 91 is able to slide horizontally with respect to the cover main body 89 within a predetermined range. As shown in FIG. 5, the lock member 91 includes a hook portion 91*a* that protrudes vertically with respect to the cover main body 89. The lock member 91 is suspended by a spring not shown in the figures, for the hook portion 91*a* to maintain the protruding posture. As shown in FIG. 6B, upper surface of the hook portion 91*a* is angled. Hence, in the course of the storage cover 76 shifting to its closed state, the angled upper surface of the hook portion 91*a* makes contact with the upper edge portion 74*b* of the storage main body 74. As the storage cover 76 is rotated more towards the storage main body 74, the hook portion 91 is pressed down, by the upper edge portion 74*b*, and the lock member 91 slides downward. The hook portion 91*a* is inserted into the insert hole 74*c* that is located behind the upper edge portion 74*b*. When the hook portion 91*a* is fully inserted in the insert hole 74*c*, the hook portion 91*a* is released from the pressure against the upper edge portion 74*b*. Thus, the lock member 91 slides upward, suspending the storage cover 76 to maintain its closed state. FIG. 6A shows the closed state of the storage cover 76 at the right most storage room 78. The other storage rooms 78 are indicated without the storage cover 78.

As shown in FIGS. 5, 6A and 6B, the lock release lever 92 has the shape of a rectangular plate, and is arranged at the upper end of the exterior surface of the cover main body 89. The lock release lever 92 is connected to the cover main body 89 with a supporting pin 92*a*, and rotates with respect to the cover main body 89 (see FIG. 8). In the present embodiment, the lock release lever 92 is able to rotate between a state which the lock release lever 92 is horizontal to the exterior surface of the cover main body 89 (see FIGS. 8 and 12B) and a state which the lock release lever 92 is vertical to the exterior surface of the cover main body 89 (see FIG. 5). Within such range, the lock release lever 92 can be rotated to be in an angled state (see FIG. 6B).

Figure 12A:
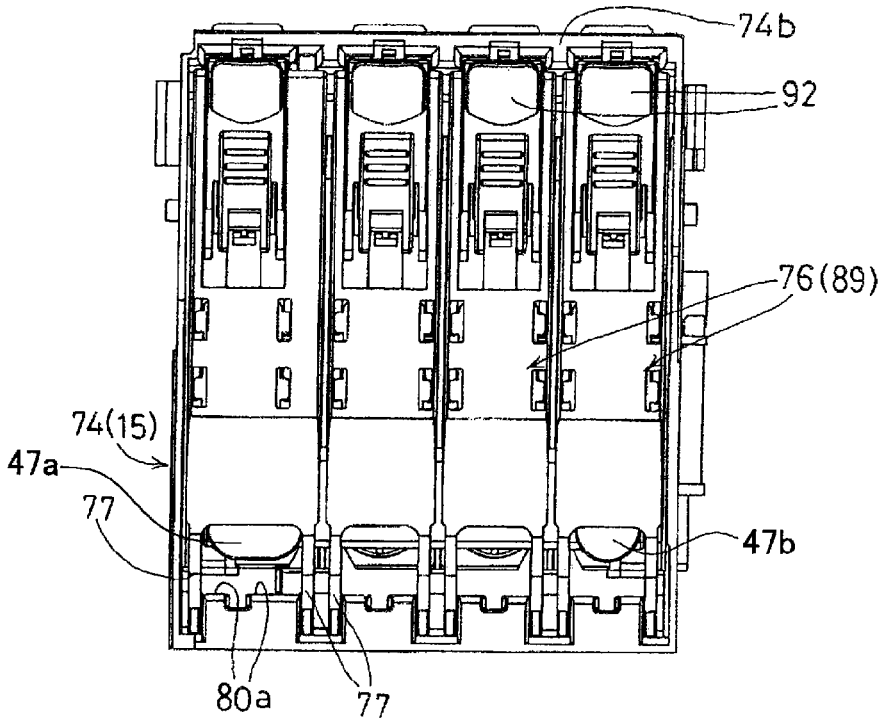
FIG. 12A shows a front view of an ink cartridge storage unit with a protection device installed.
Figure 12B:
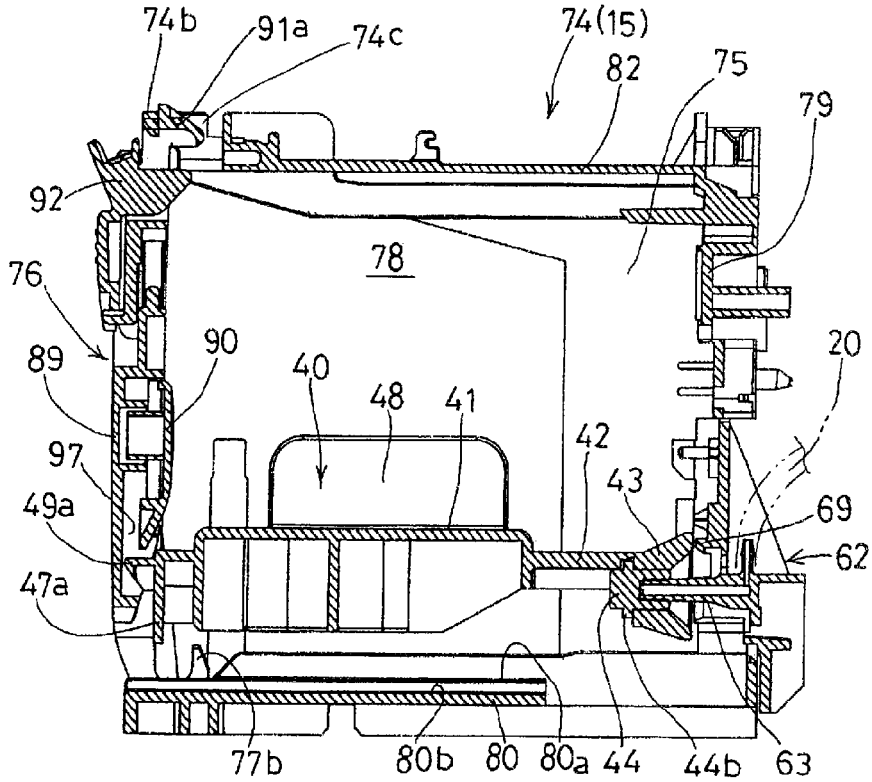
FIG. 12B shows a cross sectional side view of FIG. 12A.

The lock release lever 92 further includes a cam portion 92*b* (see FIG. 6B). When the storage cover 76 is in its closed state, as shown in FIGS. 12A and 12B, the lock member 91 and the lock release lever 92 are in horizontal position with respect to the cover main body 89. The lock release lever 92 is pulled downward from the horizontal state to either the angled or vertical state. The cam portion 92*b* makes contact with the lower part of the lock member 91, as shown in FIG. 6B, and presses the lock member 91 downward. The lock member 91 thus slides downward, releasing the hook portion 91*a* from the insert hole 74*c*. The lock of the storage cover 76 is released, and the storage cover 76 can be rotated further to the opened state.

The ink cartridge 60 is exchanged by the procedures described below. The storage cover 76 is opened, and the used ink cartridge 60 is removed from the storage room 78. In the course of rotating the storage cover 76 to the opened state, the curved portion 77*b* of the lever member 77 catches the hook member 64*a* of the cartridge main body 64, slightly sliding the cartridge main body 64 towards the front opening 74*a* side (see FIG. 8). The ink cartridge 60 can be easily withdrawn manually, because the rear part of the ink cartridge is already pulled out of the storage room 78. When a new ink cartridge 60 is installed into the storage room 78, it is installed into the storage room 78 through the front opening 74*a*. The lower front side of the ink cartridge 60 is supported by the pair of lever member 77, and guided by the pair into the storage room 78. Meanwhile, the bottom surface of the ink cartridge 60 slides along and above the guiding rails 80*a*. Within the configuration as mentioned, the ink cartridge 60 can be exchanged easily and accurately.

With the new ink cartridge 60 installed inside the storage main body 74, the storage cover 76 can be rotated towards the closed state. In the course of rotating to the closed state, the weight support member 90 makes contact with the front side surface of the ink cartridge 60, and presses the ink cartridge 60 against the rear side surface of the storage room 78. When the hook portion 91*a* of the lock member 91 is fully inserted into the insert hole 74*c*, the storage cover 76 is positioned in its closed state.

After the ink cartridge 60 is installed inside the storage main body 74, the ink inducing valve 65 of the ink cartridge 60 is connected to the ink inducing tube 63 of the connector 62. The ink from the ink cartridge 60 is provided to the print head 4 through the ink inducing tube 63 and the ink tube 20. Simultaneously, the air valve 85 is pressed against the storage main body 74, and the pushing rod 84 is pushed back inside the air valve 85. The checking valve is therefore opened, and air is induced inside the cartridge main body 64 in accordance with the amount of ink provided to the print head 4. With the aforementioned configuration, an efficient ink provision for the printer 7 can be materialized.

In the course of shipping or transporting the MFD 1, a protection device 40 is equipped inside the storage main body 74 instead of the ink cartridges 60. The configuration of the protection device 40 is described in the description below.

The embodiment of the protection device 40 is shown in FIG. 10A to 10D. FIG. 10A, FIG. 10B, FIG. 10C and FIG. 10D show perspective views of the protection device 40 from different angles. The protection device 40 of the present embodiment is configured to correspond to the ink cartridge storage unit 15 of which four ink cartridges 60 can be installed. Moreover, the protection device 40 of the present embodiment is configured to protect the ink inducing tubes 63 that are arranged on the rear side surface that is vertical with respect to the bottom plate 80 of the storage main body 74.

The protection device 40 includes a flat-parallelogram shaped main body 41 that includes a front face and a rear face, a plurality of supporting beams 42 connected to the front face of the main body 41, funnel members 43 equipped at a distal end of each supporting beam 42, and elastic caps 44 equipped inside each funnel member 43. As shown in FIGS. 10A to 10D, the protection device 40 has a different shape compared to the sets of ink cartridges 60. As shown in the aforementioned figures, the main body 41 of the protection device 40 does not need to be formed in the similar or identical shape as the ink cartridge 60. The main body 41 of the present embodiment has a thin, rectangular parallelogram shape.

The main body 41, the supporting beams 42, and the funnel members 43 are made of pliable materials such as synthetic resin, by using methods such as injection molding method, for example, and are formed as one component. The main body 41, the supporting beams 42, and the funnel members 43 can be made of other pliable materials, as long as the supporting beams 42 are resilient. The elastic caps 44 are made of materials with high pliability, such as compound rubber.

FIG. 12A shows a front view of the ink cartridge storage 15 with the protection device 40 installed, and FIG. 12B shows a cross sectional side view of FIG. 12A. As shown in FIG. 12B, each elastic cap 44 is columnar shaped, with a concaved portion 44*a* formed at one end. The concaved portion 44*a* (see FIG. 13) is configured to fit with the distal end of the ink inducing tube 63. At the other end of the elastic cap 44, that is, the end inserted into the funnel member 43, a brim portion 44*b* is formed. The brim portion 44*b* has longer peripheral length than the main body portion of the elastic cap 44, and is protruding vertically on the main body portion of the elastic cap.

Since the protection device 40 has a different shape from the ink cartridge 60, it is not guided along the side surfaces of the separator 75, as is the case with the ink cartridges 60. In the course of inserting the protection device 40 inside the storage main body 74, the protection device 40 can be inserted, aiming the funnel member 43 to cover the ink inducing tube 63. The distal end of the ink inducing tube 63 is guided towards the concaved portion 44*a* of the elastic cap 44 inside the funnel member 43, and engaged therewith, while the rear side surface (that is, the surface facing the front opening 74*a*) of the main body 41 is pressed against the interior side surface of the cover main body 89. The main body 41 of the protection device 40 can be maintained horizontal with respect to the ink inducing tube 63, in a manner that the main body 41 does not make contact with the guiding rails 80*a* nor the bottom plate 80.

Furthermore, since the protection device 40 is hanging in the air inside the storage room 78 with the pressing force exerted horizontally on the main body 41 from the storage cover 76 and the rear side surface of the storage main body 74, the protection device 40 is preferred to weigh less. Further, in order to maintain the force exerted on the main body 41 efficiently, the main body 41 should comprise high pliability. For such reasons, the main body 41 and the supporting beams 42 are thinly formed in the present embodiment. Moreover, each supporting beam 42 is cavernously formed as a semicircular tube with a hollow inside. The main body 41 is composed like a hollow box with its bottom surface open. Such configuration enhances the pliability of the protection device 40.

The main body 41 includes a top plate 41*a*, side plates 41*b* on left and right side respectively, a front plate 41*e* (that is, the front face), and a rear plate 41*d* (that is, the rear face). At the rough center of the top plate 41*a*, a concave 41*f* is formed. The concave 41*f* is utilized as a grip in the course of inserting and removing the protection device 40 from the storage main body 74. As clearly shown in FIGS. 10B and 10D, a plurality of reinforcing ribs 41*g* are formed on the bottom side surface of the main body 41 (that is, the exterior side surface of the concave 41*f*). The reinforcing ribs 41*g* each connects the exterior side surface of the concave 41*f* with the side plate 41*b* on left side, the side plate 41*b* on right side, the front plate 41*e*, and the rear plate 41*d* respectively.

In the closed state of the storage cover 76, the storage cover 76 presses the main body 41 towards the rear plate 79 side, and the funnel members 43 are pressed toward the rear side surface of the storage main body 74. Coincidentally, the elastic caps 44 are covering and sealing the ink inducing tubes 63. The sealing of the ink inducing tubes 63 and the elastic caps 44 are enhanced by the pliability of the protection device 40 itself, and the protection device 40 is prevented from being misaligned with respect to the ink inducing tube 63, or from falling off. A tightly sealed state of the ink inducing tube 63 can be maintained during the shipping or transporting the MDF 1.

Figure 13:
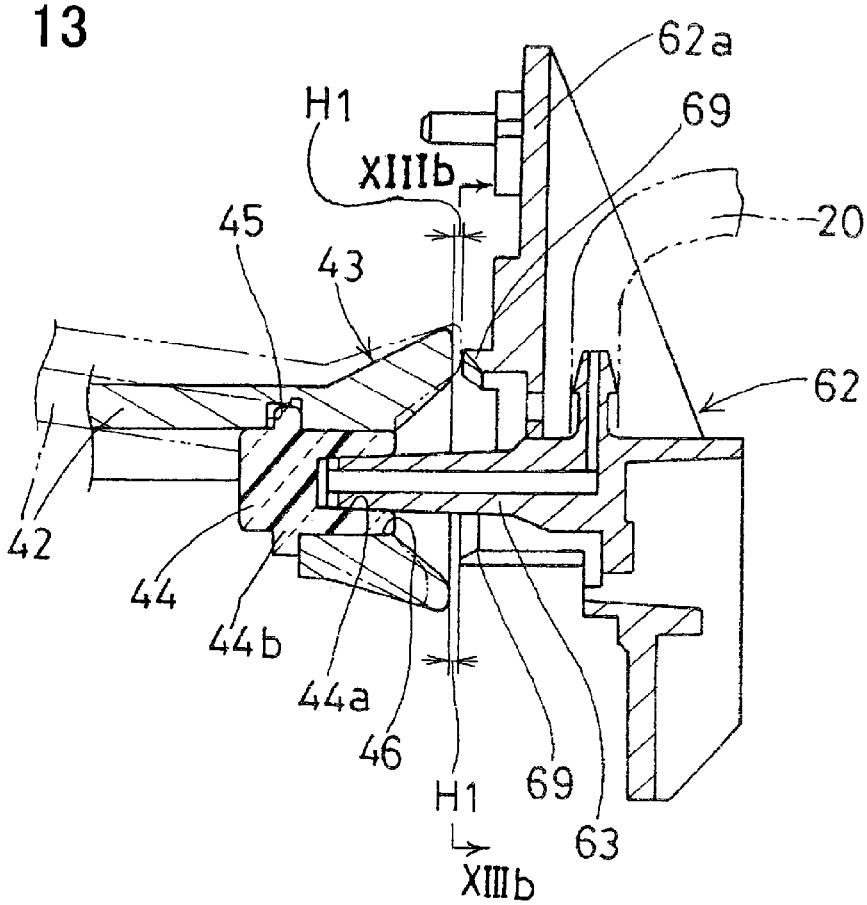
FIG. 13 shows an enlarged cross sectional side view of an ink inducing tube and a protection device.

FIG. 13 shows an enlarged cross sectional side view of the ink inducing tube 63 and a part of the protection device 40. At the connecting section of the supporting beam 42 and the funnel member 43, as shown in FIG. 13, a semicircular groove 45 and an engage hole 46 is formed. The semicircular groove 45 engages with roughly half of the periphery of the brim portion 44*b* of the elastic cap 44. The elastic cap 44 can be inserted within the engage hole 46, which is formed on the interior surface of the funnel member 43. Such configuration engages the brim portion 44*b* and the semicircular groove 45, thus suspending the elastic cap 44 at the connecting section of the supporting beam 42 and the funnel member 43 even when the elastic cap 44 is pressed in its axial direction by the insertion of the ink inducing tube 63. Furthermore, in the case of removing the protection device 40 by manually pulling the concave 41*f* (the grip), the elastic cap 44 remains in position due to the engagement of the brim portion 44*b* and the semicircular groove 45.

Since the supporting beam 42 is formed as a semicircular tube, and the connecting section of the supporting beam 42 and the funnel member 43 has the engage hole 46, the elastic cap 44 can easily be inserted into the funnel member 43 via the hollow of the supporting beam 42 and into the engage hole 46 which is connected to the aforementioned hollow section, even though the brim portion 44*b* has a longer peripheral length than the main body portion of the elastic cap 44.

As shown in FIG. 13, in a sealed state where the ink inducing tube 63 is engaged with the concaved portion 44*a* of the elastic cap 44, a certain amount of clearance H1 is formed in between the rim of the funnel member 43 and the guiding ribs 69 of the connector 62.

With such clearance between the guiding ribs 69 and the funnel member 43, even when ink leak occurs around the guiding ribs 69, the leaking ink can be prevented from dripping onto the funnel member 43.

Furthermore, even in the case where the protection device 40 is firmly pressed frontward in the course of insertion, the funnel member 43 cannot be inserted further than where the guiding ribs 69 are arranged. The ink inducing tube 63 is thus protected, preventing any damage thereof.

Figure 10A:
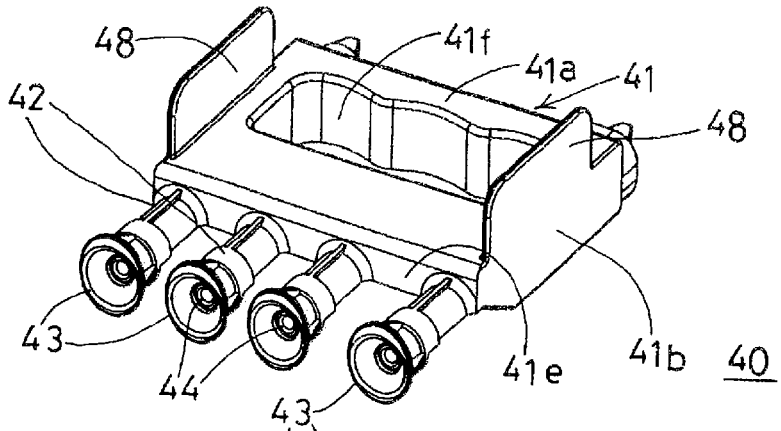
FIG. 10A, FIG. 10B, FIG. 10C and FIG. 10D show perspective views of a protection device from different angles.
Figure 10B:
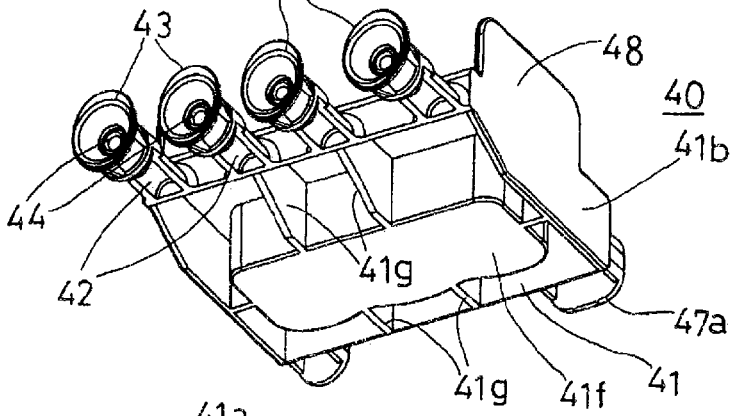
Figure 10C:
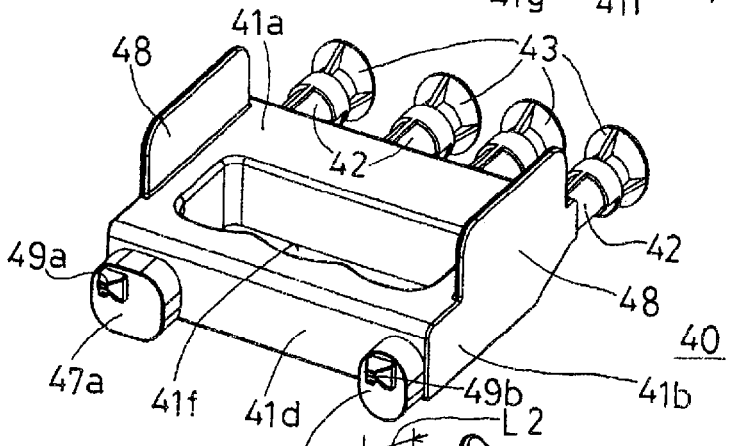
Figure 10D:
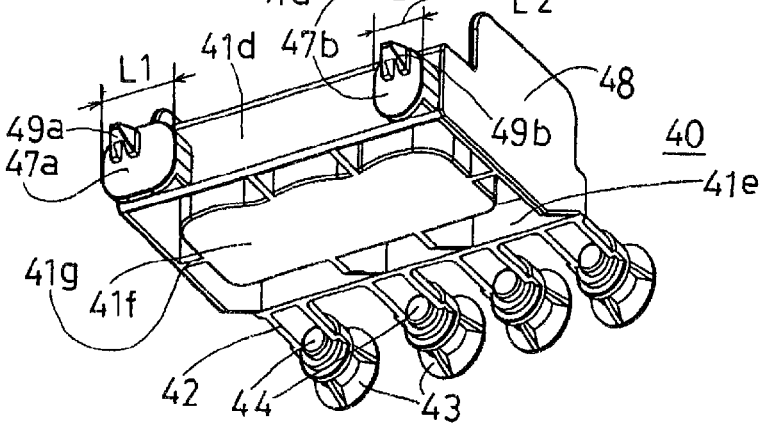

As shown in FIGS. 10C, 10D, and 11, guiding protrusions 47*a* and 47*b* are horizontally formed on the left and right sides of the rear plate 41*d* respectively. FIG. 11 shows a perspective view of the protection device 40 installed in the ink cartridge storage unit 15. The guiding protrusions 47*a* and 47*b* are protruding vertically with respect to the surface of the rear plate 41*d*. The guiding protrusions 47*a* and 47*b* are located at a position corresponding to the location of which the lever members 77 are arranged on the cover main body 89. The guiding protrusions 47*a* and 47*b* each fits in between the pair of corresponding lever members 77 in the course of closing the storage cover 76, and thus is guided therein. With such configuration, even in a case where one of the storage covers 76 either on the left side or the right side is closed first, one of the guiding protrusions 47*a* and 47*b* is guided by the corresponding lever member 77, and the protection device 40 is horizontally pushed into the storage room 78.

In FIG. 11, the width of the guiding protrusions 47*a* and 47*b*, L1 and L2, each corresponds to the width between the curved portions 77*b* of the lever member 77 for the left most storage room 78 and the right most storage room 78 respectively. More specifically, the widths L1 and L2 of the guiding protrusions 47*a* and 47*b* is equal to or smaller than the widths between the curved portions 77*b* of the corresponding lever members 77 respectively. Hence, the guiding protrusions 47*a* and 47*b* fit in between the corresponding curved portions 77*b* in the closed state. Even in a case where the guiding protrusions 47*a* and 47*b* are slightly located inappropriately in the left and right direction (that is, in the case of having a poor alignment of the protection device 40 and the ink inducing member 63, or an improper insertion of the protection device 40), the guiding protrusions 47*a* and 47*b* are guided by the corresponding pair of lever members 77, and thus the position of the protection device 40 in the left and right direction with respect to the direction of insertion is modified. With the configuration as described above, the alignment of the protection device 40 does not need to be determined manually, thus the insertion process can be simplified. Further, liquid leakage and/or damages on the ink inducing member 63 due to the inappropriate position in the above mentioned direction is prevented.

As mentioned above, the curved portions 77*b* are utilized to engage with the hook member 64*a* of the ink cartridge 60. Hence, the width L of the guiding protrusion 47, the width W1 of the pair of lever members 77 and the width Wc of the ink cartridge 60 has the relationship which can be shown as $L \leqq W1 < Wc$.

Furthermore, the guiding protrusions 47*a* and 47*b* have different length in at least one direction. In this embodiment, the guiding protrusions 47*a* and 47*b* have different length (width) in the horizontal direction (the direction of X axis in FIG. 1).

In FIG. 11, the width of the ink cartridge 60 that is inserted into the left most storage room 78 and the width of the ink cartridge 60 that is inserted into the right most storage room 78 differ, hence the width between the curved portions 77*b* differ as well. Thus, in accordance with the lever members 77, the width L1 and L2 of the corresponding guiding protrusions 47*a* and 47*b* are different.

Furthermore, since the width L1 and L2 of the guiding protrusions 47*a* and 47*b* are different, it is useful in recognizing an inappropriate position of the protection device 40 (for example, the protection device 40 is inserted with its upside down) in the course of inserting it into the storage main body 74.

Figure 14:
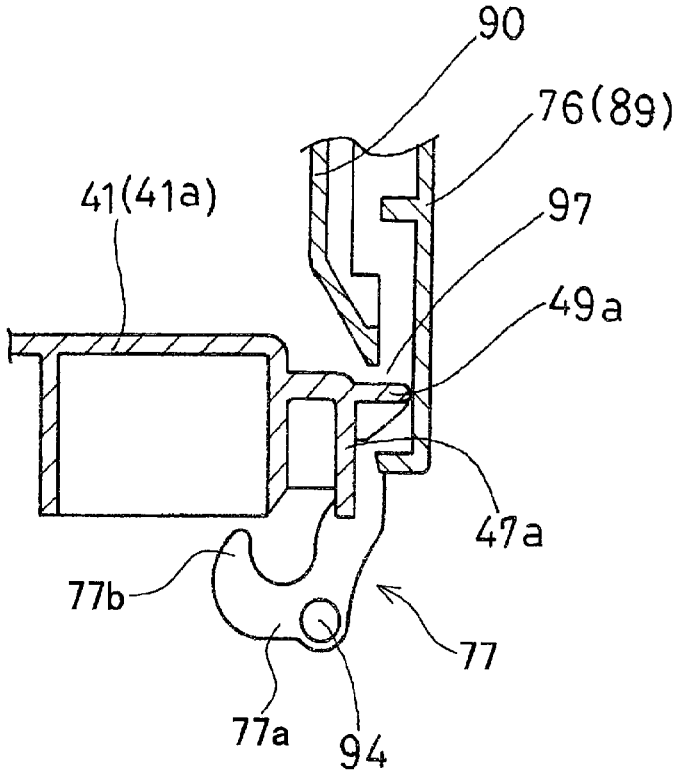
FIG. 14 shows an enlarged and notched cross sectional view of a storage cover and the rear portion of the protection device.

In the present embodiment, when the storage cover 76 is closed, the guiding protrusions 47*a* and 47*b* are guided by the corresponding pair of lever members 77, and pressed and supported by the interior side surface of the cover main body 89. In order to assure an accurate alignment of the protection device 40 and the ink inducing tube 63, it is preferable that the guiding protrusions 47*a* and 47*b* each include a positioning protrusion 49*a*, 49*b* respectively. FIG. 14 shows an enlarged and notched cross sectional view of the storage cover 76 and the rear portion of the protection device 40 (also see FIGS. 10C, 10D, and 11). The positioning protrusions 49*a*, 49*b* are formed on the guiding protrusions 47*a*, 47*b* respectively, each on a surface that faces the storage cover 76 in the closed state. The size of the positioning protrusions 49*a*, 49*b* are smaller than that of the guiding protrusion 47*a*, 47*b*. On the cover main bodies 89, on the other hand, each includes a concaved engaging portion 97 that corresponds to the positioning protrusions 47*a*, 47*b*.

The positioning protrusions 47*a*, 47*b* are guided into the concaved engaging portions 97 in the course of closing the storage cover 76, thus the position of the protection device 40 in the height direction as well as the left and right direction with respect to the direction of insertion is modified. The posture of the guiding protrusions 47*a*, 47*b* in the height direction with respect to the storage cover 76 is also determined.

In such case, as clearly shown in FIG. 14, the positioning protrusions 47*a*, 47*b* have one surface that narrows at an angle towards the distal end, and the narrowing distal end is rounded. Such configuration of the positioning protrusions 47*a*, 47*b* enables the insertion into the engaging positions 97 to be easy. On the other hand, the engaging portions 97 may be tapered.

The fins 48 (that are, the regulation plates) of the protection device 40 stand in the vertically upper direction with respect to the top plate 41*a* of the main body 41. They are utilized to notify an inappropriate positioning of the protection device 40 in the course of insertion. If the protection device 40 is inserted into the storage main body 74 with its upside down, the funnel member 43 is placed at a higher position than where the ink inducing tube 63 is located. Thus, in a misaligned state, the fins 48 block the funnel member 43 from engaging with the ink inducing tube 63. Such misalignment is easily recognized, and damages due to such misalignment do not occur.

In the case where the fins 48 have the upper edge angled with the height of the fins 48 on the supporting beam 42 side is lower than the guiding protrusions 47*a*, 47*b* side, the protection device 40 is tilted when it is upside down. The funnel member 43 will be facing downward, hence the funnel members 43 cannot be engaged with the ink inducing tube 63 in such state.

Furthermore, it is preferable that the fins 48 have round corners, or the upper edge of the fins 48 are angled with the height of the fins 48 on the supporting beam 42 side is lower than the guiding protrusion 47*a*, 47*b* side. When the protection device 40 is inserted into the storage main body 74 in a wrong position, for example, with its topside down, the protection device 40 cannot be stably inserted with the fins 48 protruding in the lower direction. This is useful in recognizing a misaligned position of the protection device 40 in the course of inserting it into the ink cartridge storage unit 15.

In the course of removing the protection device 40, the main body 41 can be lifted upward. During the lifting, a part of the interior surface of the elastic cap 44 that is pressed against the ink inducing tube 63 is constricted, and the upper rim of the funnel member 43 makes contact with the surface of the distal end of the guiding rib 69*a*. With the contact point as its leverage fulcrum, the main body 41 can be lifted higher. The elastic cap 44 is angled by the lifting, and the upper rim making contact with the distal surface of the guiding rib 69*a* slides downward while the position of the elastic cap 44 with respect to the ink inducing tube 63 is shifted with the constriction. As the result, the sealing of the concaved portion 44*a* and the ink inducing tube 63 becomes loose. By forming rim of the funnel member 43 in a partially elongated round, the funnel member 43 enables the elastic cap 44 to be unfastened from the ink inducing tube 63 with small effort.

In the case where the rim of the funnel member 43 is biased outwards with respect to the axis of the guiding ribs 69, the biased section should be formed parallel to the direction of which the fins 48 are arranged. In such case, when the protection device 40 is inserted inside the storage main body 74 in a proper position with the fins 48 standing vertically upward with respect to the bottom plate 80 of the storage main body 74, damages caused by the elastic cap 44 in the course of removal can be surely prevented.

In the present embodiment, the figure of the main body 41 of the protection device 40 is defined as a figure that partially occupies the space within the storage main body 74. For example, the main body 41 and the supporting beams 42 occupy less than about half the space required for storing the sets of the ink cartridges 60.

The present invention can be embodied with the opening of the storage main body 74 formed at its top surface, with the ink inducing tube 63 arranged on the bottom surface inside the main body 74, protruding upward. The protection device 40 is then, in such case, inserted through the opening at the top surface vertically with respect to the bottom side surface of the storage main body 74.

The embodiments described above referred to a printer of off-carriage type, but it goes without saying that the present invention can be embodied with a printer of on-carriage type.

What is claimed is:

1. A protection device for ink cartridge storage unit having a storage main body with one side having an opening, an ink inducing member arranged on a surface of the main body facing the side having the opening, and a cover member for covering the opening, wherein the cover member is connected to the storage main body and rotates between an opened state and a closed state, and includes a pair of projections arranged on an interior surface of the cover member that faces the ink inducing member in the closed state, the protection device comprising:

a main body having an front face and a rear face, wherein the front face horizontally faces the rear face;

a sealing member connected to the main body, the sealing member protruding from the front face, wherein the sealing member seals the ink inducing member in the closed state; and a guiding protrusion arranged at the rear face, wherein the guiding protrusion protrudes from the rear face, and the width of the guiding protrusion is equal to or smaller than the width between the pair of projections, and the guiding protrusion is guided in between the pair of projections in the course of rotating the cover member to its closed state.

2. The protection device as in claim 1, wherein:

the cover member includes a concave portion formed at the interior surface; and the guiding protrusion includes a positioning protrusion arranged at a surface of the guiding protrusion, wherein the positioning protrusion is protruding from the surface and engages with the concave portion in the closed state, and the size of the positioning protrusion is equal to or smaller than the size of the guiding protrusion.

3. The protection device as in claim 2, wherein at least one side surface of the positioning protrusion is angled, and the positioning protrusion narrows towards a distal end.

4. The protection device as in claim 1, wherein a plurality of guiding protrusions is arranged in a line order at the rear face of the main body.

5. The protection device as in claim 4, wherein one of the plurality of guiding protrusions has a different length in at least one direction from the other of the plurality of guiding protrusions.

6. The protection device as in claim 1, wherein the sealing member including:

a supporting beam connected to the main body, the supporting beam protruding towards the ink inducing member;

a funnel member having a narrow conical end and a wide conical end, the narrow conical end being connected to a distal end of the supporting beam; and an elastic cap arranged inside the funnel member, wherein the elastic cap seals the ink inducing member in an engaged state;

wherein when the protection device is angled toward a direction, a part of the wide conical end corresponding to the direction makes contact with the surface where the ink inducing member is arranged and slides thereon.

7. The protection device as in claim 6, wherein the supporting beam is made of pliable material and can be resiliently bent in the vertical direction with respect to its axis direction.

8. The protection device as in claim 1, further comprising:

a regulation plate horizontally connected to the main body with respect to the front face.

9. The protection device as in claim 8, wherein the regulation plate allows the movement of the protection device in the horizontal direction with respect to the regulation plate.

* * * * *